US011299931B2

(12) United States Patent
Mcneill et al.

(10) Patent No.: US 11,299,931 B2
(45) Date of Patent: Apr. 12, 2022

(54) WAND ASSEMBLY FOR USE WITH A VERTICAL ARCHITECTURAL-STRUCTURE COVERING

(71) Applicant: Hunter Douglas Inc., Pearl River, NY (US)

(72) Inventors: David B. Mcneill, Denver, CO (US); Todd Michael Nelson, Louisville, CO (US); Charles Culver Gidden Cooper, Arvada, CO (US); Cameron Joseph Bennethum, Denver, CO (US); Jeffrey L. Spray, Erie, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 16/835,390

(22) Filed: Mar. 31, 2020

(65) Prior Publication Data

US 2021/0071474 A1 Mar. 11, 2021

Related U.S. Application Data

(60) Provisional application No. 62/898,107, filed on Sep. 10, 2019.

(51) Int. Cl.
*E06B 9/36* (2006.01)

(52) U.S. Cl.
CPC ..... *E06B 9/364* (2013.01)

(58) Field of Classification Search
CPC . E06B 9/364; E06B 9/368; E06B 9/36; E06B 9/361; E06B 9/362; E06B 9/307;
(Continued)

(56) References Cited

U.S. PATENT DOCUMENTS 64,976 A 5/1867 Harvey
2,587,859 A 3/1952 King
(Continued)

FOREIGN PATENT DOCUMENTS

WO 2015172754 A1 11/2015

OTHER PUBLICATIONS

Author Unknown, "Vertical Blinds Wand & Cord" Hunter Douglas—retrieved Apr. 5, 2019, 2 pages.
(Continued)

*Primary Examiner* — Johnnie A. Shablack
(74) *Attorney, Agent, or Firm* — Kacvinsky Daisak Bluni PLLC

(57) ABSTRACT

A wand assembly for use with an architectural-structure covering is disclosed. The wand assembly may include a first operating element (e.g., an operating cord) for moving the covering between extended and retracted positions and a second operating element (e.g., a tilt wand) for adjusting rotation of the covering between open and closed configurations. The first and second operating elements are coupled to a handle assembly via separate and distinct coupling mechanisms so that manipulation of the second operating element does not affect the first operating element thereby preventing twisting of the first operating element about the second operating element. The wand assembly may include a first, inner rotatable wand and a second, stationary outer wand. The inner wand is rotatable relative to the outer wand so that rotation of the inner wand does not rotate the outer wand, and hence the first operating element coupled to the outer wand.

82 Claims, 18 Drawing Sheets

(58) Field of Classification Search
CPC ... E06B 9/326; E06B 2009/285; A47H 5/032; A47H 5/00; A47H 5/02
See application file for complete search history.

(56) References Cited

U.S. PATENT DOCUMENTS

| | | | | |
|---|---|---|---|---|
| 3,246,894 | A | 4/1966 | Salisbury | |
| 3,299,943 | A | 1/1967 | Poe | |
| 4,122,884 | A | 10/1978 | Salzmann | |
| 4,257,470 | A | 3/1981 | Woodle | |
| 4,366,852 | A | 1/1983 | Holzer | |
| D294,669 | S | 3/1988 | Litowitz | |
| 4,936,369 | A * | 6/1990 | Darner | E06B 9/361 160/168.1 R |
| 5,103,889 | A | 4/1992 | Ford | |
| D331,681 | S | 12/1992 | Schaefer et al. | |
| 5,323,834 | A | 6/1994 | Toti | |
| 5,465,779 | A * | 11/1995 | Rozon | E06B 9/326 160/168.1 V |
| 5,472,035 | A | 12/1995 | Biba et al. | |
| 5,553,649 | A * | 9/1996 | Chisaka | E06B 9/306 160/168.1 R |
| 5,553,653 | A * | 9/1996 | Rozon | E06B 9/326 160/173 R |
| 5,662,154 | A | 9/1997 | Drake, III | |
| 5,671,793 | A * | 9/1997 | Lee | E06B 9/307 160/168.1 R |
| 5,749,405 | A | 5/1998 | Huang | |
| 5,845,695 | A | 12/1998 | Cadorette et al. | |
| 5,853,039 | A * | 12/1998 | Fraser | E06B 9/307 160/176.1 V |
| 6,089,303 | A * | 7/2000 | Metcalf | E06B 9/307 160/176.1 R |
| 6,164,363 | A | 12/2000 | Colson et al. | |
| 6,196,293 | B1 | 3/2001 | Lee | |
| 6,311,756 | B1 | 11/2001 | Anderson et al. | |
| 6,360,806 | B1 * | 3/2002 | Bowman | E06B 9/36 160/168.1 V |
| 6,792,999 | B2 | 9/2004 | Cross et al. | |
| 6,817,401 | B2 | 11/2004 | Sun et al. | |
| 6,983,784 | B2 | 1/2006 | Anderson et al. | |
| 7,082,982 | B2 | 8/2006 | Eveland et al. | |
| 7,793,700 | B2 | 9/2010 | Bossler | |
| D690,783 | S | 10/2013 | Chen | |
| 8,544,525 | B2 | 10/2013 | Zhu | |
| 8,561,667 | B1 | 10/2013 | Hanley et al. | |
| 8,739,852 | B2 | 6/2014 | Anderson et al. | |
| 8,763,675 | B2 | 7/2014 | Zhu | |
| 8,931,538 | B2 * | 1/2015 | Ho | E06B 9/326 160/168.1 R |
| 9,194,177 | B2 | 11/2015 | Anthony et al. | |
| 9,284,774 | B2 | 3/2016 | Yu et al. | |
| 9,757,604 | B2 | 9/2017 | Carter | |
| 9,879,475 | B2 | 1/2018 | Mullet et al. | |
| 10,072,458 | B2 | 9/2018 | Mullet et al. | |
| 10,655,385 | B2 | 5/2020 | McNeill et al. | |
| D932,683 | S | 10/2021 | Mao | |
| D935,804 | S | 11/2021 | Kim et al. | |
| D939,241 | S | 12/2021 | Kim et al. | |
| 2011/0174449 | A1 | 7/2011 | Huang | |
| 2012/0285631 | A1 | 11/2012 | Zhu | |
| 2014/0096918 | A1 | 4/2014 | Horst | |
| 2015/0007674 | A1 * | 1/2015 | Gramsch | F16H 19/06 74/89.2 |
| 2017/0241198 | A1 | 8/2017 | McNeill et al. | |
| 2021/0071474 | A1 | 3/2021 | Mcneill et al. | |
| 2021/0222487 | A1 | 7/2021 | Luo et al. | |

OTHER PUBLICATIONS

Bret at Going Vertical., "Vertical Blind Diagram" Going-Vertical—retrieved Apr. 5, 2019, 4 pages.

Author Unknown, "Luminette® Privacy Sheers" Hunter Douglas—2017.

Author Unknown, "Luminette® Privacy Sheers and Modern Draperies" Hunter Douglas—2010.

* cited by examiner

WAND ASSEMBLY FOR USE WITH A VERTICAL ARCHITECTURAL-STRUCTURE COVERING

CROSS-REFERENCE TO RELATED APPLICATIONS

This is a non-provisional of, and claims the benefit of the filing date of, U.S. provisional patent application No. 62/898,107, filed Sep. 10, 2019, entitled "Wand Assembly for Use with a Vertical Architectural-Structure Covering," which application is incorporated by reference herein in its entirety.

FIELD OF THE DISCLOSURE

The present disclosure relates generally to the field of architectural-structure coverings, and relates more particularly to an improved wand assembly for use in an architectural-structure covering such as a vertical architectural-structure covering (e.g., horizontally-extending and retracting architectural-structure covering).

BACKGROUND

Architectural-structure coverings may selectively cover an architectural structure such as, for example, a window, a doorway, a skylight, a hallway, a portion of a wall, etc. Architectural-structure coverings may come in a variety of configurations. One common type of architectural-structure covering is a vertical (horizontally-extending) architectural-structure covering.

A vertical (horizontally-extending) architectural-structure covering may include a head rail assembly and a covering. In use, the covering or components thereof (e.g., loops, vanes, etc.) are vertically suspended from the head rail assembly. The head rail assembly is operatively associated with a control system. The architectural-structure covering may also include an operating mechanism including one or more operating elements such as, for example, a tilt wand and a pull cord system (e.g., an operating cord). In use, the operating cord may be used to move the covering between an extended position and a retracted position. As will be readily appreciated by one of ordinary skill in the art, in the extended position, the covering may extend widthwise across the architectural structure (e.g., window), while in the retracted position, the covering may be retracted to reveal the architectural structure. That is, in use, the operating cord may be manipulated by a user to extend and to retract (e.g., move) the covering in a horizontal direction along a length of the head rail assembly. Thus, the operating cord may be manipulated to control or adjust the amount of extension or retraction of the covering across the architectural structure.

In addition, the one or more operating elements (e.g., tilt wand) may also operatively control or adjust the angle or tilt of the covering or components thereof to move the covering or components thereof between an open configuration and a closed configuration. As will be readily appreciated by one of ordinary skill in the art, in the open configuration, the covering or components thereof are rotated, pivoted, tilted, etc. (used interchangeably herein without the intent to limit) so that view through the covering is possible, while in the closed configuration, the covering or components thereof are rotated relative to each other to prevent, or at least substantially inhibit, view through. Thus, in use, the tilt wand may be manipulated to pivot the covering or components thereof. That is, with the covering in the extended position, the tilt wand may be manipulated by a user to pivot the covering or components thereof to substantially block view through. By controlling or adjusting the rotation of the covering or components thereof in the extended position and by moving the covering between the extended and retracted positions, the user can control or adjust view through the covering and hence, as applied to coverings or windows, the user is able to vary the amount of natural light permitted to enter, for example, the room via the window by adjusting the angular position of the covering or components thereof.

Generally speaking, the control system includes a plurality of carriers (generally vertically extending) from which the covering is suspended, and a tilt rod that extends longitudinally within the head rail assembly. In use, operation of the one or more operating elements manipulate the carriers. That is, during use, the carriers are movably positioned within the head rail assembly (e.g., slidably movable along a length of the head rail assembly) so as to move the covering between the extended and retracted positions. For example, generally speaking, the operating cord extends into and along a length of the head rail assembly. During use, manipulation of the operating cord controls or adjusts movement of the carriers between the extended and retracted positions. In addition, manipulation of the tilt wand pivotably moves the covering between the open and closed configurations. For example, each of the carriers includes a carrier body, a gear, and a hanger pin for coupling to the covering. The tilt rod passes through an opening formed in each of the carrier bodies. The tilt rod includes circumferentially spaced teeth that mesh with the gear positioned in each of the carriers. Manipulation of the tilt wand rotates the tilt rod, which is operatively coupled to the gear located in each of the carriers. Thus arranged, rotation of the tilt rod causes the gear to rotate relative to the carrier body, which, in turn, causes the hanger pin to rotate, which pivots the covering between the open and closed configurations.

Additional information on the structure and operation of known vertical (horizontally-extending) architectural-structure coverings including the control system, operating mechanism, and the components thereof, can be found in U.S. Pat. No. 5,853,039 entitled "Coupler for the Tilt Wand and Pull Cord of a Covering on Architectural Opening"; U.S. Pat. No. 6,360,806 entitled "Operation, Control and Suspension System for a Vertical Vane Covering for Architectural Openings"; and U.S. Pat. No. 6,491,085 entitled "Control and Suspension System for a Vertical Vane Covering for Architectural Openings".

One common issue with known operating mechanisms that utilize a first operating element (e.g., operating cord) to move the covering between the extended and retracted positions, and a second operating element (e.g., tilt wand) to rotate or tilt the covering between the open and closed configurations is that manipulation of the tilt wand may cause the operating cord to twist about the tilt wand, especially if the operating cord is not securely held while operating the tilt wand (e.g., operating cord twists about the shaft of the tilt wand). As such, proper operation requires a user to use both hands—one to operate or rotate the tilt wand and the other to hold the operating cord. In addition, known wand assemblies incorporate two gripping parts—a first gripping part generally positioned about midway on the wand assembly to hold the operating cord and a second gripping part generally positioned at the bottom of the wand assembly.

In addition, operation of the first and second operating elements is not always intuitive, thus causing some users to be confused as to which operating element performs which function.

It is with respect to these and other considerations that the present improvements may be useful.

SUMMARY

This Summary is provided to introduce in a simplified form, a selection of concepts that are further described below in the Detailed Description. This Summary is not intended to identify key features or essential features of the claimed subject matter, nor is it intended as an aid in determining the scope of the claimed subject matter.

Disclosed herein is an improved operating element or wand assembly for use in an architectural-structure covering such as, for example, a vertical (horizontally-extending) architectural-structure covering. In use, the wand assembly includes a gripping part arranged and configured for single-handed operation. In use, the gripping part enables a user to rotate or tilt the covering or components thereof, while preventing, or at least minimizing, twisting of the operating cords used to move the covering between the extended and retracted positions (e.g., the wand assembly includes a single gripping part at a bottom end configured for single-handed operation. The single gripping part is arranged and configured to manipulate the tilt wand for rotating the covering while ensuring that the operating cord does not twist about the tilt wand).

In one example of an embodiment, the wand assembly includes a first operating element such as, for example, an operating cord, for moving the covering horizontally between the extended and retracted positions and a second operating element such as, for example, a tilt wand assembly, for controlling or adjusting the angle or tilt of the covering, or components thereof, between the open and closed configurations. In one example of an embodiment, the wand assembly further includes a handle assembly. In use, the first operating element (e.g., the operating cord) is coupled to the handle assembly. In addition, the second operating element (e.g., tilt wand) is coupled to the handle assembly. The coupling of the second operating element to the handle assembly is separate and distinct from the coupling of the first operating element to the handle assembly so that manipulation (e.g., rotation) of the second operating element (e.g., tilt wand) is not transferred to the first operating element (e.g., operating cord).

In one example of an embodiment, this is achieved by incorporating and/or operatively coupling the handle assembly to a first, inner or rotatable wand or shaft; and a second, outer or static wand or shaft. In use, the inner wand is operatively coupled to or is part of the tilt wand, which is operatively coupled to the tilt rod of the control system located in the head rail assembly. The first operating element (e.g., operating cord) is coupled to the outer wand. The inner wand is rotatable relative to the outer wand. Thus arranged, the inner wand is arranged and configured to be manipulated by a user to move the covering between the open and closed configurations. In addition, the operating cord is arranged and configured to be manipulated by the user to move the covering between the extended and retracted positions. By separating the connection of the operating cord from the rotatable inner wand, manipulation of the inner wand (e.g., rotation of the inner wand) is not transferred to the operating cord thereby preventing twisting of the operating cord about the tilt wand assembly.

In accordance with another separate and distinct aspect of the present disclosure, the wand assembly may include a cord tensioner operatively coupled with the operating cord. In use, the cord tensioner is arranged and configured to selectively tension the operating cord relative to the outer wand to maintain the operating cord in a taunt condition.

Embodiments of the present disclosure provide numerous advantages. For example, providing a wand assembly that separately connects the first and second operating elements enables a user to manipulate (e.g., rotate) the tilt wand in a vertical (horizontally-extending) architectural-structure covering without twisting the operating cord used to move the covering between the extended and retracted positions about the tilt wand. Thus arranged, the wand assembly provides an aesthetically pleasing, intuitive assembly that is arranged and configured for single-handed operation (e.g., not necessary for the user to hold the operating cords while manipulating the tilt wand).

Further features and advantages of at least some of the embodiments of the present disclosure, as well as the structure and operation of various embodiments of the present disclosure, are described in detail below with reference to the accompanying drawings.

DETAILED DESCRIPTION

Figure 1:
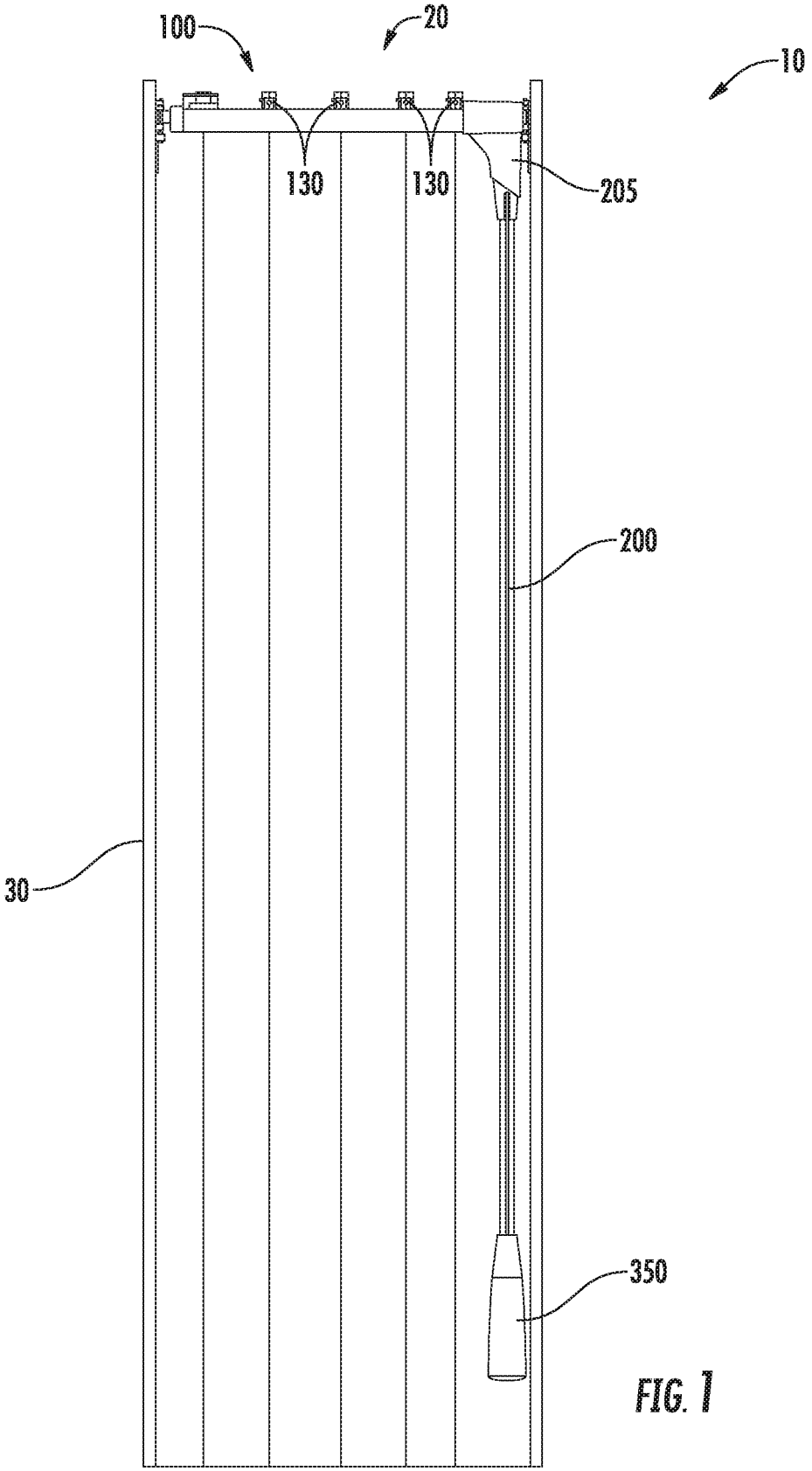
FIG. 1 is a perspective view illustrating an example of an embodiment of an architectural-structure covering including a covering, a control system, and a wand assembly (portions of the covering are omitted for clarity purposes)

Various features, aspects, or the like of an improved wand assembly or operating elements (used interchangeably herein without the intent to limit) for use with an architectural-structure covering will now be described more fully hereinafter with reference to the accompanying drawings, in which one or more aspects of the wand assembly will be shown and described. It should be appreciated that the various features, aspects, or the like may be used independently of, or in combination, with each other. It will be appreciated that a wand assembly as disclosed herein may be embodied in many different forms and may selectively include one or more concepts, features, or functions described herein. As such, the wand assembly should not be construed as being limited to the specific embodiments set forth herein. Rather, these embodiments are provided so that this disclosure will convey certain aspects of the wand assembly to those skilled in the art. In the drawings, like numbers refer to like elements throughout unless otherwise noted.

It should be understood that, as described herein, an "embodiment" (such as illustrated in the accompanying Figures) may refer to an illustrative representation of an environment or article or component in which a disclosed concept or feature may be provided or embodied, or to the representation of a manner in which just the concept or feature may be provided or embodied. However, such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the Figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. For instance, features illustrated or described as part of one embodiment can be used separately, or with another embodiment to yield a still further embodiment. Thus, it is intended that the present subject matter covers such modifications and variations as come within the scope of the appended claims and their equivalents.

As will be described in greater detail below, the wand assembly of the present disclosure may be used in connection with a control system of an architectural-structure covering such as, for example, a vertical or horizontally-extending (hereinafter "vertical") architectural-structure covering. Generally speaking, vertical architectural-structure coverings may be movable between an extended position and a retracted position. In this manner, the covering of the architectural-structure covering may be moved between the extended position, where the covering extends widthwise across a head rail assembly so that the architectural structure (e.g., window) is covered, and the retracted position, where the covering is positioned or stacked adjacent to one or both ends of the head rail assembly so that the architectural structure is substantially exposed. In addition, the covering or components thereof may be tiltable, rotatable, pivotable, etc. (used interchangeably herein without the intent to limit) so that the angle of the covering or the components thereof may be controlled or adjusted so that the covering or components thereof may be moved between an open configuration, in which the covering or components thereof are orientated so that view through the covering is possible, and a closed configuration, in which the covering or components thereof are orientated to prevent, or at least substantially inhibit, view through (e.g., covering or components thereof are rotatable to block, or at least substantially block, view through).

Figure 2:
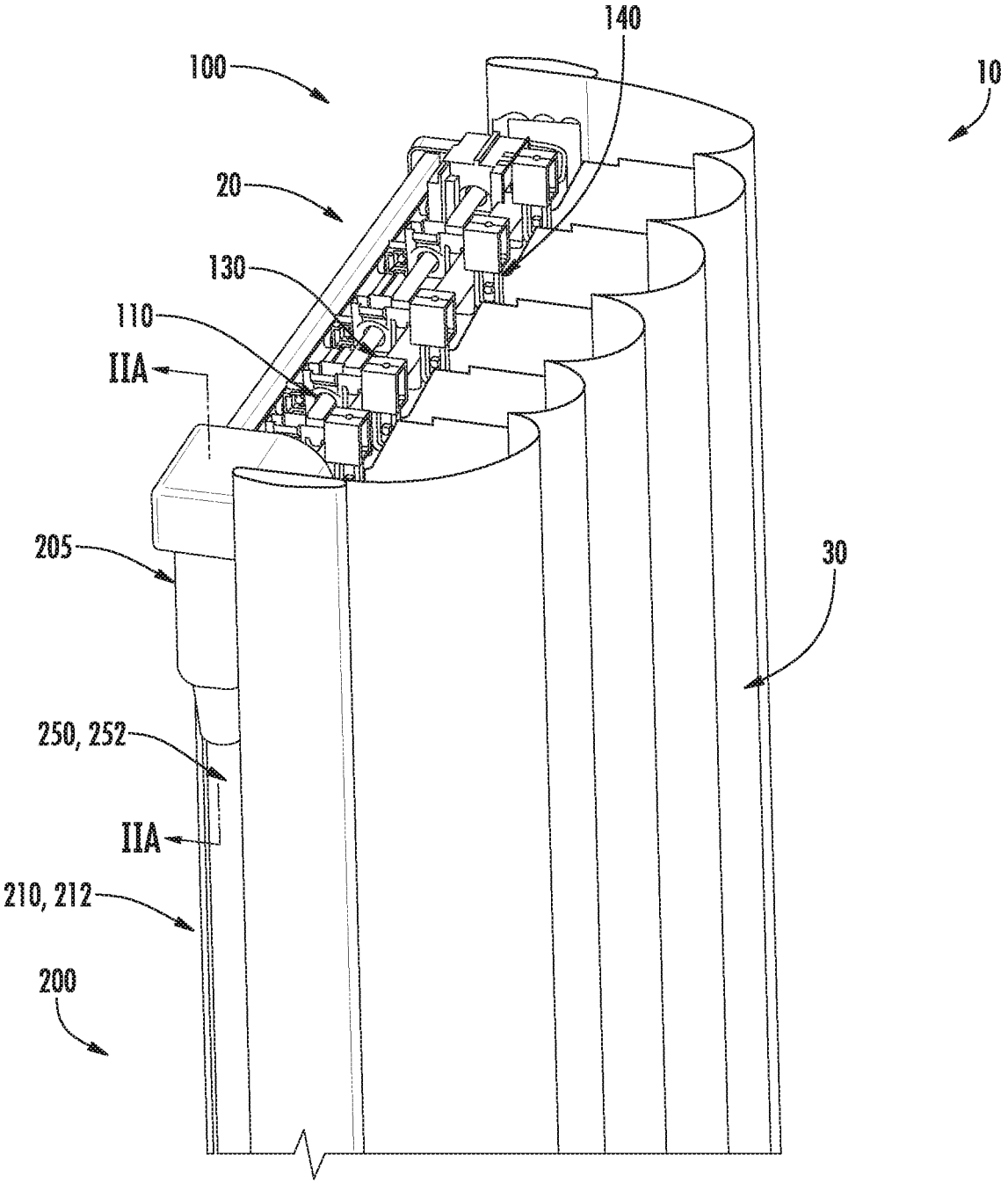
FIG. 2 is a top perspective view illustrating the architectural-structure covering in FIG. 1, the covering shown in an extended position.

Referring to FIGS. 1 and 2, a vertical architectural-structure covering 10 is shown. Although a particular example of a vertical architectural-structure covering 10 is shown, many different types and styles exist and could be employed in place of the example vertical architectural-structure covering 10 of FIGS. 1 and 2. In addition, while the improved wand assembly of the present disclosure will be described and illustrated in connection with controlling or adjusting the movement of the control system such as, for example, the carriers, and hence of the covering or components thereof in a vertical architectural-structure covering, it should be appreciated that the wand assembly may have other applications. As such, the wand assembly should not be limited solely for use with the vertical architectural-structure covering shown.

As shown, the vertical architectural-structure covering assembly 10 may include a head rail assembly 20 and a covering 30 (FIG. 2, portions omitted from FIG. 1 for clarity). In use, the covering 30 or components thereof may be suspended from the head rail assembly 20. In one embodiment, the covering 30 may be manufactured from a continuous sheet of material. Alternatively, the covering 30 may be manufactured from individual strips of material that may be coupled together. In yet another embodiment, the covering 30 may be made of a plurality of individual vanes. The covering 30 may be manufactured from any suitable material now known or hereafter developed including, for example, fabrics, plastics, metal, etc.

The head rail assembly 20 may include, for example, brackets (not shown) for mounting the vertical architectural-structure covering 10 to a wall or other structure. As will be readily appreciated by one of ordinary skill in the art, the covering 30 of the vertical architectural-structure covering 10 may be suspended from the head rail assembly 20 and may be movable along a length of the head rail assembly 20 between an extended position (shown in FIG. 2), to a partially retracted position, and further to a fully retracted position. In addition, the covering 30 or components thereof may be rotatable to control or adjust the amount of view through of the covering 30, for example, in the extended position.

As shown, the head rail assembly 20 includes a control system 100 for moving the covering 30 between the extended and retracted positions, and for moving (e.g., tilting, pivoting, rotating, etc.—terms used interchangeably without the intent to limit) the covering 30, or components thereof, between the open and closed configurations. As will be described in greater detail below, the control system 100 is at least partially positionable within the head rail assembly 20. The control system 100 includes a tilt rod 110 and a plurality of carriers 130. As will be appreciated by one of ordinary skill in the art, the control system 100 may include any number of carriers 130, the number of carriers 130 being partially dependent on the length of the vertical architectural-structure covering 10 and the desired distance between portions of the covering 30. Each carrier 130 includes a coupling mechanism 140 (FIG. 2) for coupling to the covering 30 or components thereof.

In the illustrated embodiment, the vertical architectural-structure covering 10 also includes an operating mechanism, which is operatively coupled to the wand assembly 200. In use, the operating mechanism operatively couples the wand assembly 200 with the control system 100 to move the covering 30 between the extended and retracted positions, and to control or adjust the angle of the covering 30 or components thereof to control or adjust the rotation of the covering 30 or components thereof. As will be described in greater detail below, in one example of an embodiment, the wand assembly 200 includes a first operating element 210 for moving the covering 30 between the extended and retracted positions and a second operating element 250 for controlling or adjusting the position, orientation, configuration, angle, etc. (used interchangeably herein without the intent to limit) of the covering 30 or components thereof (e.g., the second operating element 250 may be used to rotate the tilt rod 110 so that the covering 30 or components thereof can be pivoted about respective longitudinal vertical axes extending through the carriers 130 between an open configuration wherein the covering 30 and/or components thereof are positioned to permit view through the covering 30 and a closed configuration wherein the covering 30 and/or components thereof are rotated to block, or at least substantially block, the passage of light and view through the covering 30).

As will be described in greater detail below and as will be appreciated by one of ordinary skill in the art, in one example of an embodiment, the first operating element 210 is in the form of an operating cord or pull cord 212 for moving the covering 30 between the extended and retracted positions. That is, in use, the operating cord 212 is operatively coupled to the carriers 130 within the head rail assembly 20 so that movement of the operating cord 212 moves the carriers 130, and hence the covering 30, along the length of the head rail assembly 20. As will be appreciated by one of ordinary skill in the art, the operating cord 212 may be arranged as an endless loop so that operating (e.g., pulling) one side of the operating cord 212 causes the carriers 130 to move in a first direction (e.g., extension direction) while operating (e.g., pulling) on the opposite side of the operating cord 212 causes the carriers 130 to move in the second, opposite direction (e.g., retraction direction). In use, the operating cord 212 can be operatively coupled to the carriers 130 by any now known or hereafter developed method including, for example, those known and described in, for example, U.S. Pat. No. 5,853,039 entitled "Coupler for the Tilt Wand and Pull Cord of a Covering on Architectural Opening"; U.S. Pat. No. 6,360,806 entitled "Operation, Control and Suspension System for a Vertical Vane Covering for Architectural Openings"; and U.S. Pat. No. 6,491,085 entitled "Control and Suspension System for a Vertical Vane Covering for Architectural Openings".

As will be described herein, the features according to the present disclosure may be used with any suitable architectural-structure covering now known or hereafter developed. As such, the features of the present disclosure that will be described herein should not be limited to the details of the architectural-structure covering unless specifically claimed.

For the sake of convenience and clarity, terms such as "front," "rear," "top," "bottom," "up," "down," "vertical," "horizontal", "inner," and "outer" may be used herein to describe the relative placement and orientation of various components and portions of the vertical architectural-structure covering 10, and are non-limiting. Said terminology will include the words specifically mentioned, derivatives thereof, and words of similar import.

In one accordance with one aspect of the present disclosure, the integrated wand assembly 200 may include or be operatively associated with the first operating element 210 (e.g., the operating cord 212) for moving the covering 30 horizontally between the extended and retracted positions, and the second operating element 250 (e.g., tilt wand 252) for controlling or adjusting the angle of the covering 30 or components thereof between the open and closed configurations. In one example of an embodiment, as will be described in greater detail below, the integrated wand assembly 200 includes a first or inner rotatable wand or shaft, and a second or outer, static wand or shaft. In use, the first operating element 210 (e.g., operating cord 212) is coupled to the outer wand. Meanwhile, the second operating element 250 (e.g., tilt wand 252) is operatively coupled to the inner wand so that, in use, the inner wand is coupled to the tilt rod 110 of the control system 100 located in the head rail assembly 20. The inner wand is rotatable relative to the outer wand. Thus arranged, the inner wand is arranged and configured to be manipulated by a user to move the covering 30 between the open and closed configurations. In addition, the operating cord 212 is arranged and configured to be manipulated by the user to move the covering 30 between the extended and retracted positions. By separating connection of the operating cord 212 from the rotatable inner wand, manipulation of the inner wand (e.g., rotation of the inner wand) is not transferred to the operating cord 212, thereby preventing twisting of the operating cord 212 about the tilt wand 252 (e.g., not causing the operating cord 212 to twist about the tilt wand 252).

Figure 3:
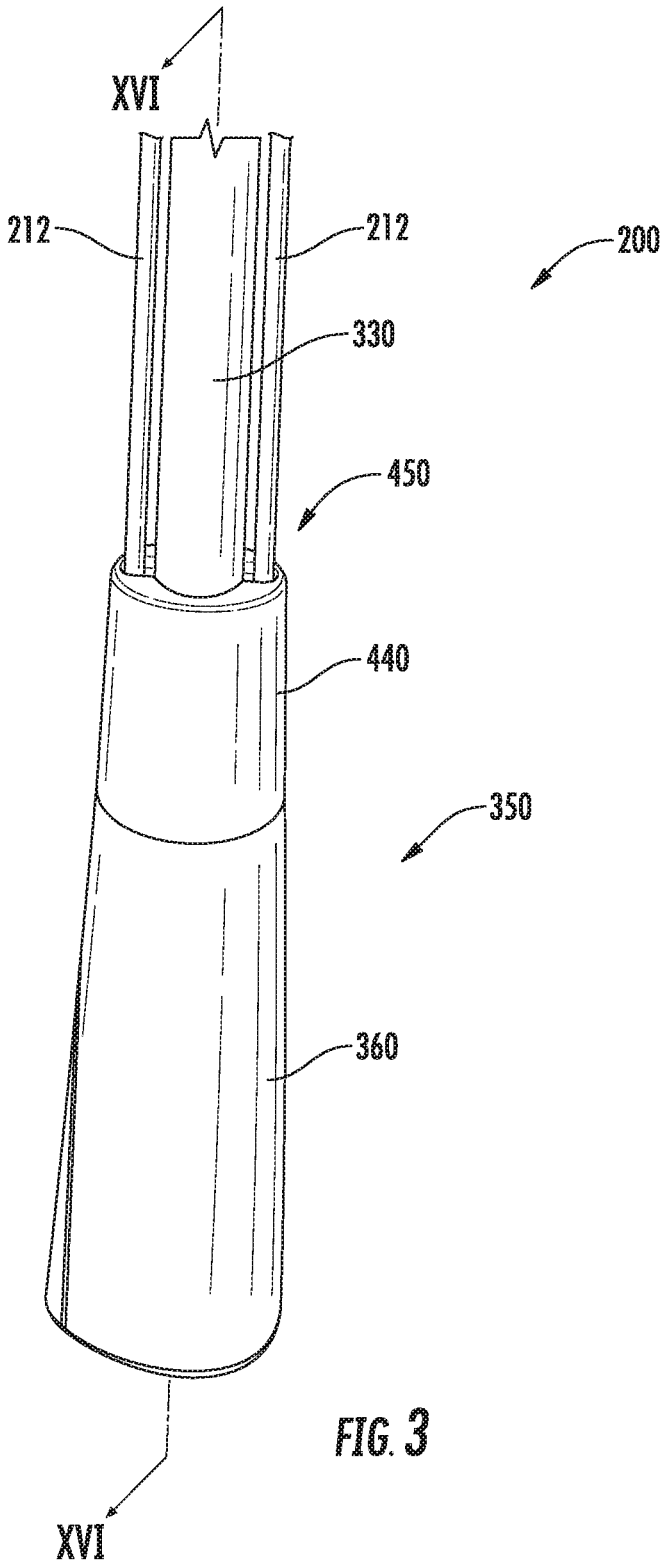
FIG. 3 is a detailed, perspective view of an example embodiment of the wand assembly shown in FIG. 1.
Figure 4:
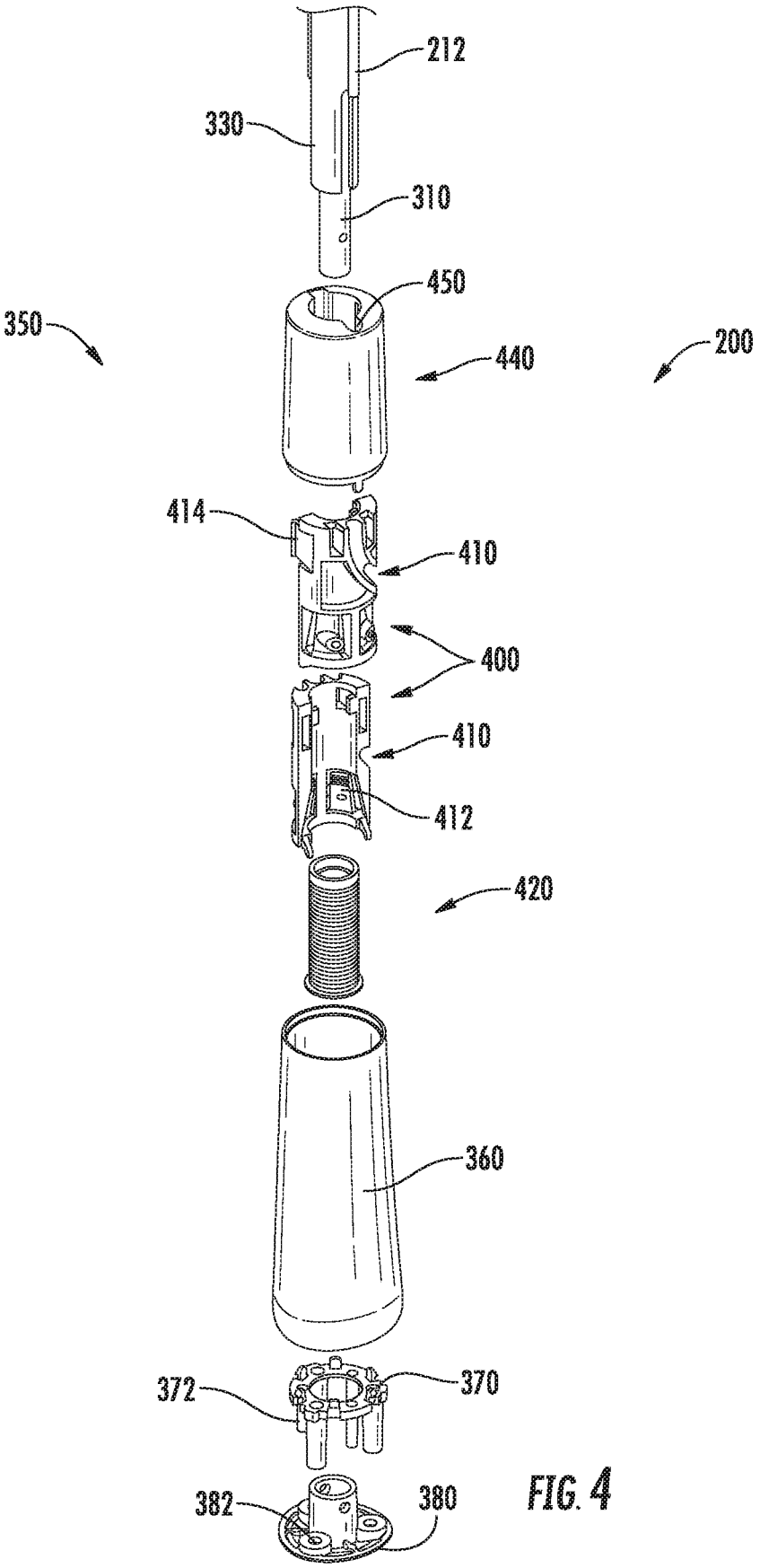
FIG. 4 is an exploded perspective view of the wand assembly shown in FIG. 3.
Figure 16:
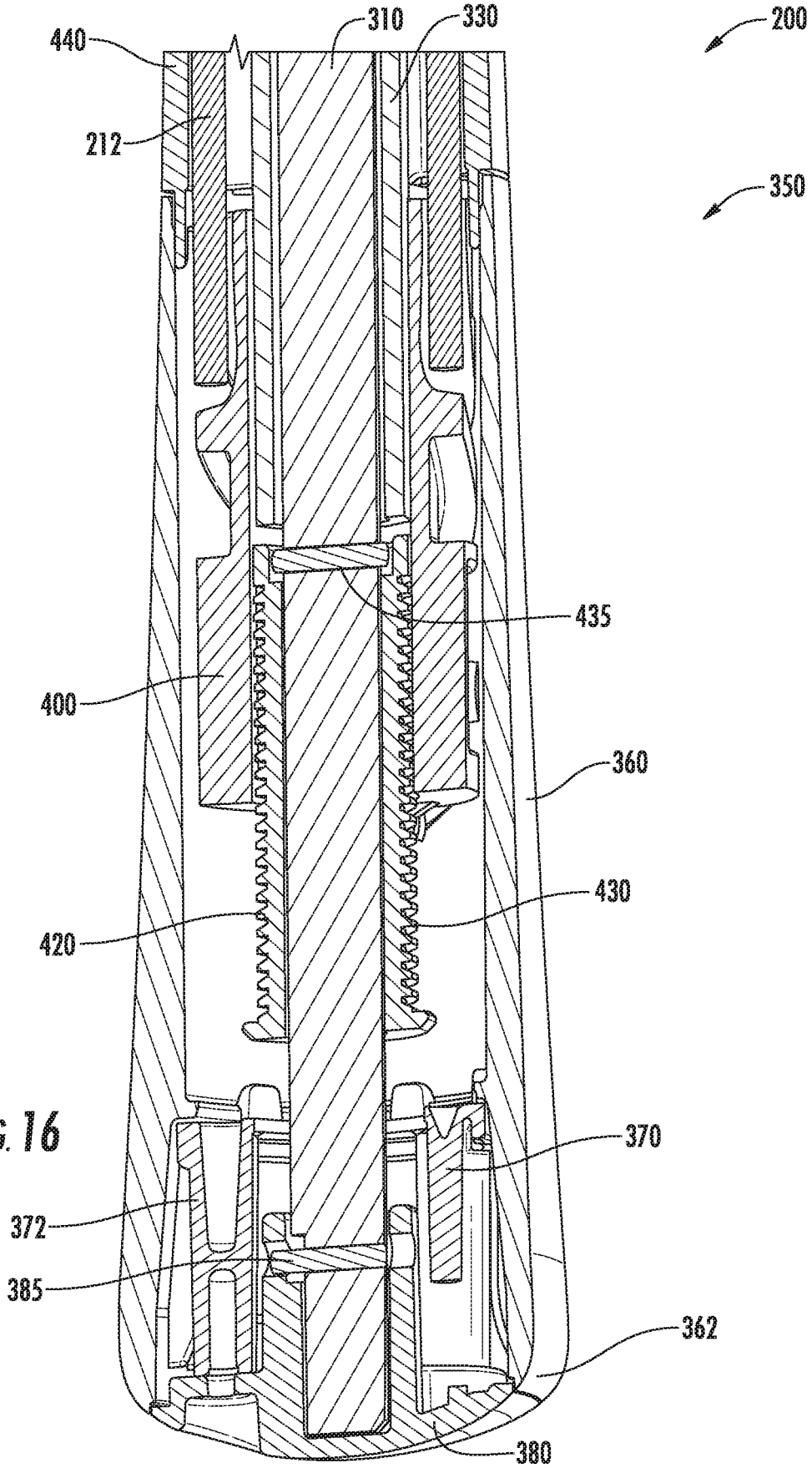
FIG. 16 is a cross-sectional view of the handle assembly shown in FIG. 3, the cross-sectional view taken along line XVI-XVI in FIG. 3.

Referring now to FIGS. 3, 4, and 16, in one example of an embodiment, an improved integrated wand assembly 200 will now be described. As shown, the integrated wand assembly 200 may include an inner wand 310 (FIGS. 4 and 16), an outer wand 330, and a handle assembly 350. In use, the inner wand 310 is rotatable relative to the outer wand 330. Moreover, in one embodiment, the inner wand 310 is operatively coupled to the control system 100 in the head rail assembly 20. The upper end of the inner wand 310 may be coupled to the control system 100 by any now known or hereafter developed mechanism such as, for example, as disclosed in U.S. Pat. No. 6,360,806 to Bowman et al. In use, manipulation of the inner wand 310 manipulates the control system 100 including, for example, the tilt rod 110 and the plurality of carriers 130 to move the covering 30 between the opened and closed configurations. As such, the inner wand 310 may be configured as, or be operatively coupled to, the tilt wand 252.

Figure 2A:
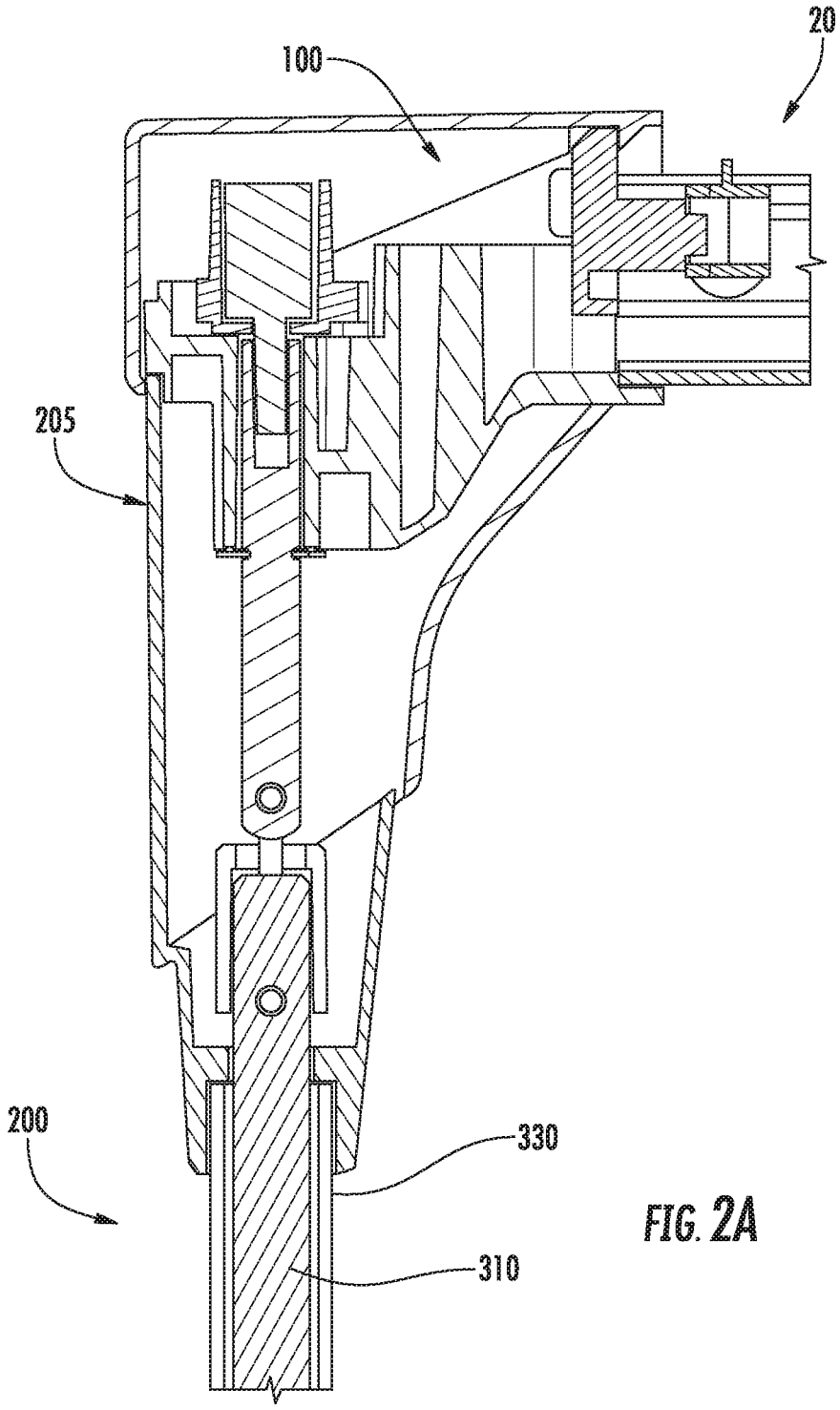
FIG. 2A is a cross-sectional view illustrating an example of an embodiment of the wand assembly shown in FIG. 2 coupled to a control system of the architectural-structure covering, the cross-section taken at line IIA-IIA in FIG. 2.

Moreover, referring to FIGS. 1-2A, a flexible coupler 205 may be used to couple the wand assembly 200 to the head rail assembly 20. That is, the flexible coupler 205 may be used to couple the outer wand 330 to the head rail assembly 20. In use, the flexible coupler 205 is arranged and configured to cover the connection between the outer wand 330 and the head rail assembly 20. In addition, in one example of an embodiment, the flexible coupler 205 is arranged and configured to allow multi-direction movement (e.g., universal pivoting) of the wand assembly 200 with respect to the head rail assembly 20. That is, the flexible coupler 205 may be arranged and configured to provide universal pivoting between the outer wand 330 and the head rail assembly 20. In addition, the inner wand 310 may be coupled to the control system 100 by a coupling mechanism arranged and configured to provide universal pivoting between the inner wand 310 and the control system 100. Thus arranged, in one example of an embodiment, the wand assembly 200 is allowed to universally pivot relative to the head rail assembly 20. In one example of an embodiment, the flexible coupler 205 is inherently stiff enough to prevent rotation of the outer wand 330. In one embodiment, an adapter may be used to operatively couple the outer wand 330 to the flexible coupler 205 to prevent, or at least substantially inhibit, rotation of the outer wand 330.

The lower end of the inner wand 310 may be operatively coupled to a portion of the handle assembly 350 so that manipulation of the handle assembly 350 (e.g., rotation) manipulates, moves, rotates, etc. the inner wand 310, which manipulates, moves, rotates, etc. the tilt rod 110, which moves the covering 30 or components thereof between the open and closed configurations. Thus arranged, for the sake of convenience, the inner wand 310 may also be referred to as a rotatable wand, a non-static wand, an operating wand, and/or the tilt wand.

In one example of an embodiment, as will be described in greater detail below, the first operating element 210 (e.g., operating cord 212) for moving the covering 30 between the extended and retracted positions is operatively coupled, or at least stabilized, held in place, or the like, to the outer wand 330. As previously mentioned, in use, the outer wand 330 is non-rotatably coupled to the flexible coupler 205, which is non-rotatably coupled to the head rail assembly 20. Thus arranged, the outer wand 330 may also be referred to as a static wand. In one embodiment, the operating cord 212 may be coupled to the outer wand 330 by any now known or hereafter developed mechanism for preventing relative rotation between the operating cord 212 and the outer wand 330 while enabling the operating cord 212 to be manipulated (e.g., pulled) by the user to move the covering 30 between the extended and retracted positions.

Figure 11:
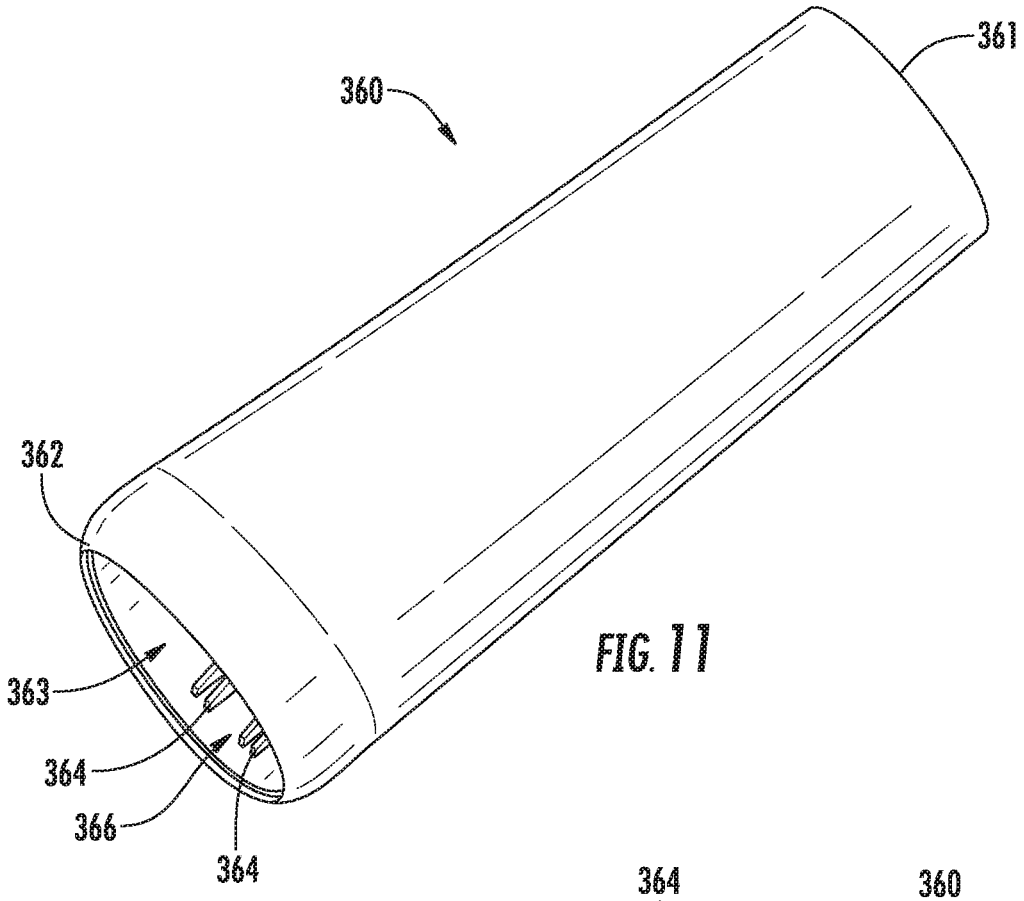
FIG. 11 is a side perspective view illustrating an example of an embodiment of a handle portion used in connection with the wand assembly shown in FIG. 3.

Referring to FIGS. 3, 4, 11, 12, and 16, the handle assembly 350 may include a handle or gripping portion 360. In use, the handle portion 360 is operatively coupled to the inner wand 310 so that rotation of the handle portion 360 rotates the inner wand 310, and hence the tilt rod 110 and the covering 30, or components thereof, between the open and closed configurations. As will be described in greater detail, the handle portion 360 is decoupled (e.g., not engaged or coupled) from the outer wand 330 so that rotation of the handle portion 360 does not rotate, affect, manipulate, etc. the outer wand 330. Thus arranged, rotation of the handle portion 360 and hence the inner wand 310 is not transferred to the outer wand 330, and hence to the operating cord 212, thus preventing, or at least minimizing, twisting of the operating cord 212 about the outer wand 330. Referring to FIG. 11, the handle portion 360 includes a top end 361, a bottom end 362, and a bore 363 extending between the top and bottom ends 361, 362.

The handle portion 360 may be coupled to the inner wand 310 by any now known or hereafter developed mechanism for achieving the function, operation, result, and/or operation described herein. Referring to FIGS. 4 and 13-16, in one example of an embodiment, the handle assembly 350 may include a handle retainer 370 and a bottom cap 380. As will be described in greater detail below, the handle retainer 370 and the bottom cap 380 are coupled to the handle portion 360 and to the inner wand 310 so that rotation of the handle portion 360 rotates the handle retainer 370, the bottom cap 380, and the inner wand 310 to move the tilt rod 110, which moves the covering 30 between the open and closed configurations for adjusting the amount of view through. In one example of an embodiment, as will be described in greater detail below, the handle portion 360 (e.g., the bore 363) is arranged and configured so that movement of the handle portion 360 does not affect movement of the elements of the handle assembly 350 other than engagement with the inner wand 310 via the handle retainer 370 and the bottom cap 380 so that the handle portion 360 can rotate without affecting (e.g., twisting) the operating cord 212. That is, the handle portion 360 is arranged and configured so that movement of the handle portion 360 is not transferred to the outer wand 330, the cord tether 400, nor the cord tensioner 420 such that rotation of the handle portion 360 is not transferred to the operating cord 212.

In one example of an embodiment, the bottom cap 380 is arranged and configured to close the bottom end 362 of the handle portion 360. In addition, and/or alternatively, the bottom cap 380 may be keyed to the bottom end 362 of the handle portion 360 so that rotation of the handle portion 360 rotates the bottom cap 380 in unison. In addition, the bottom cap 380 may be coupled to the handle retainer 370. For example, as shown, the bottom cap 380 may be coupled to the handle retainer 370 by fasteners such as, for example, screws, although other mechanisms for coupling the bottom cap 380 to the handle retainer 370 is envisioned such as, for example, a snap-fit connection. As shown, the handle retainer 370 may include a plurality of channels 372 for receiving fasteners that pass through openings 382 formed in the bottom cap 380.

Figure 12:
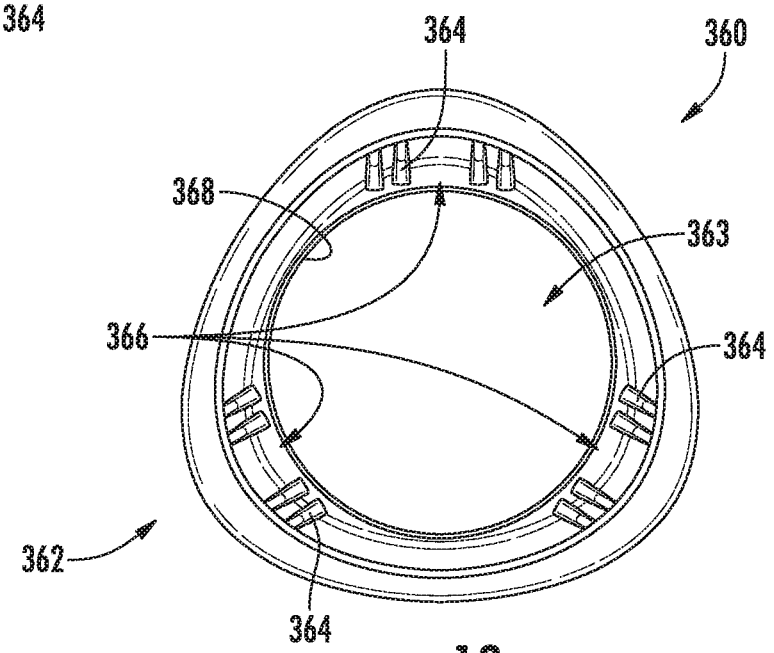
FIG. 12 is a bottom end view of the handle portion shown in FIG. 11.
Figure 13:
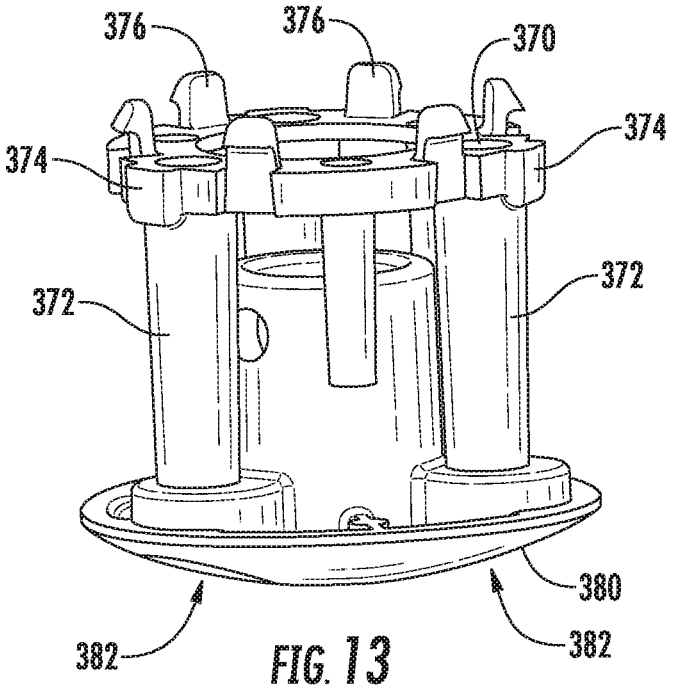
FIG. 13 is a perspective view illustrating an example of an embodiment of a bottom cap and a handle retainer used in connection with the wand assembly shown in FIG. 3.
Figure 14:
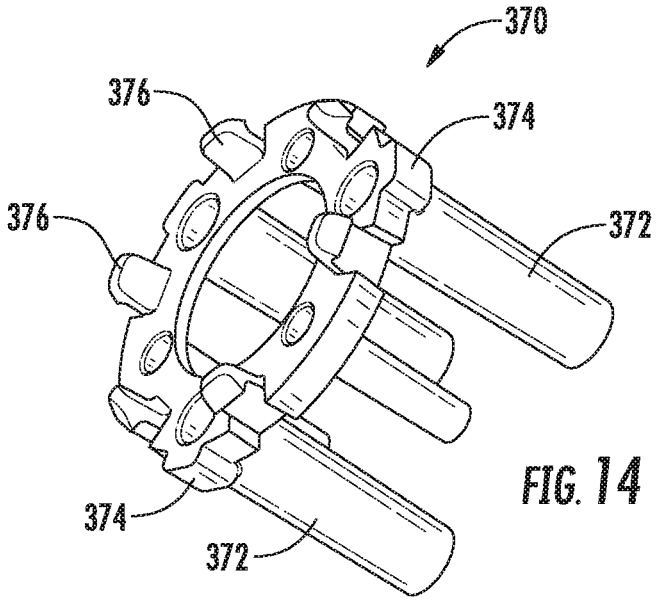
FIG. 14 is a perspective view of the handle retainer shown in FIG. 13.
Figure 15:
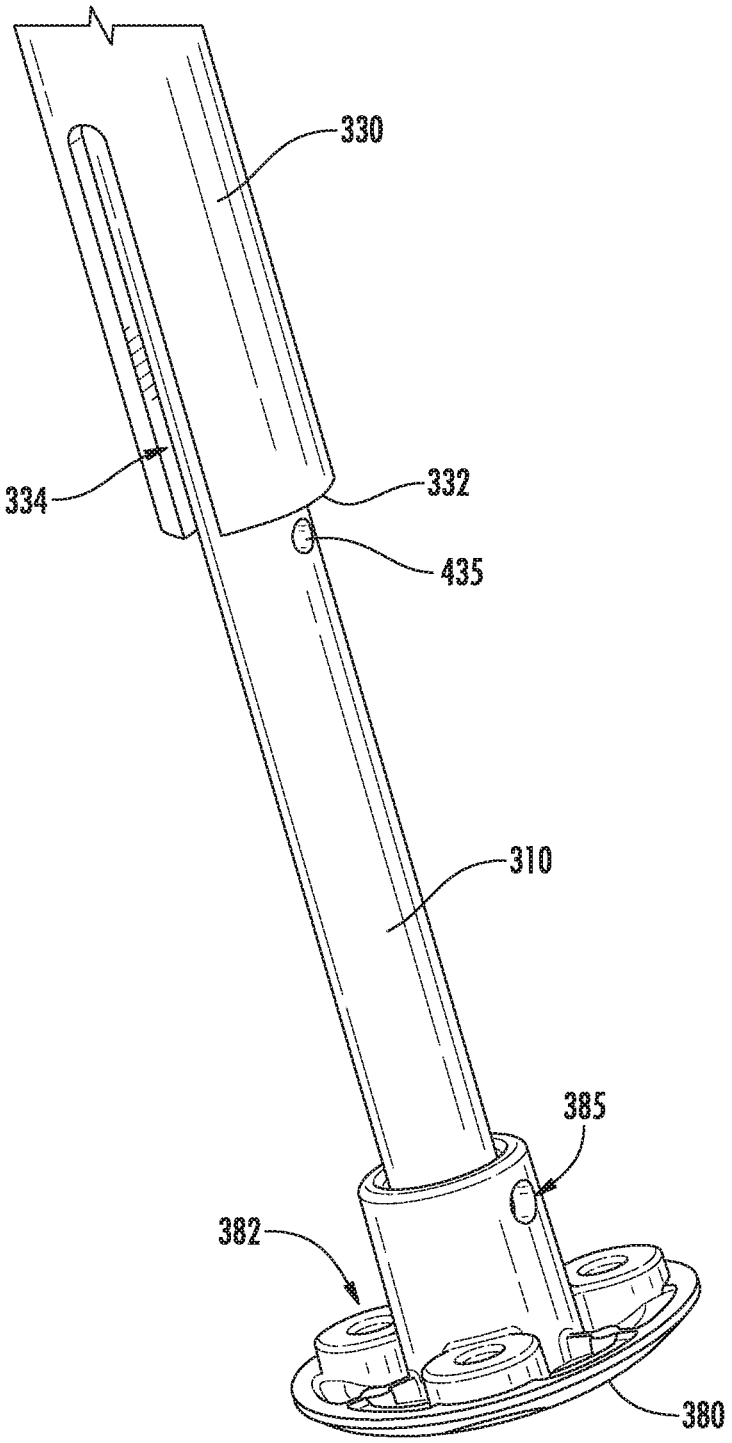
FIG. 15 is a perspective view illustrating the bottom cap shown in FIG. 13 coupled to an inner wand as used in connection with the wand assembly shown in FIG. 3.

In addition, and/or alternatively, the bottom cap 380 may be coupled to the inner wand 310. For example, as shown in FIGS. 15 and 16, the bottom cap 380 may be coupled to the inner wand 310 via a transverse cross-pin 385, although other mechanisms for coupling the bottom cap 380 to the inner wand 310 are envisioned. In addition, and/or alternatively, the handle portion 360 and the handle retainer 370 may include one or more alignment features to align and guide insertion of the handle retainer 370 within the bore 363 of the handle portion 360. For example, in one example of an embodiment, as shown in FIGS. 11 and 12, the bottom end 362 of the handle portion 360 may include inwardly extending projections 364 defining one or more alignment grooves 366 and/or an inwardly extending ridge or ledge 368. As shown in FIGS. 13 and 14, the handle retainer 370 may include one or more outwardly extending ribs or guides 374 for mating with the alignment grooves 366 formed on the inner surface of the handle portion 360 to align and guide insertion of the handle retainer 370 within the bore 363 of the handle portion 360, although other alignment mechanisms are envisioned. In addition, the handle retainer 370 may include one or more tangs or snaps 376 for coupling to the inwardly extending ridge or ledge 368 for coupling the handle retainer 370 to the handle portion 360. Thus arranged, the handle portion 360 is coupled to the inner wand 310 via the bottom cap 380 and the handle retainer 370 so that, in use, manipulation (e.g., rotation) of the handle portion 360 is transferred to the inner wand 310.

Figure 7:
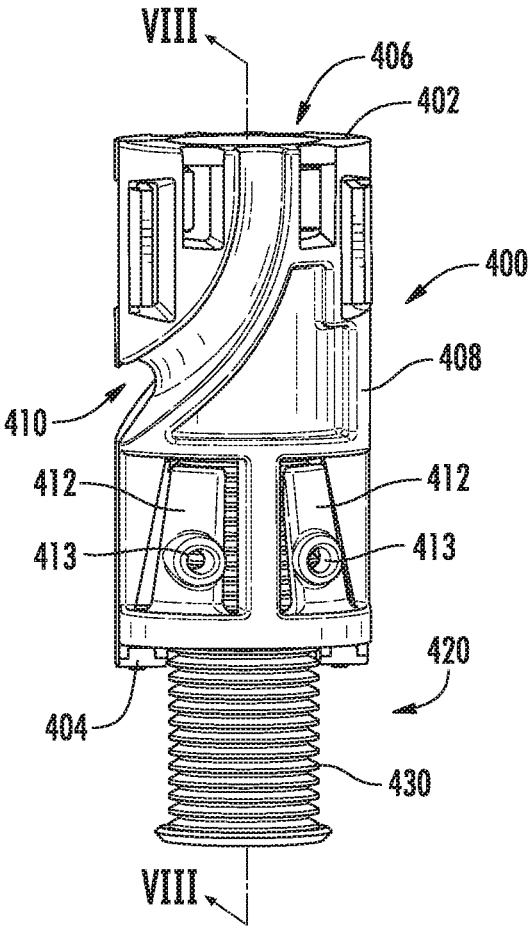
FIG. 7 is a side perspective view illustrating an example of an embodiment of a cord tether and a cord tensioner used in connection with the wand assembly shown in FIG. 3.
Figure 8:
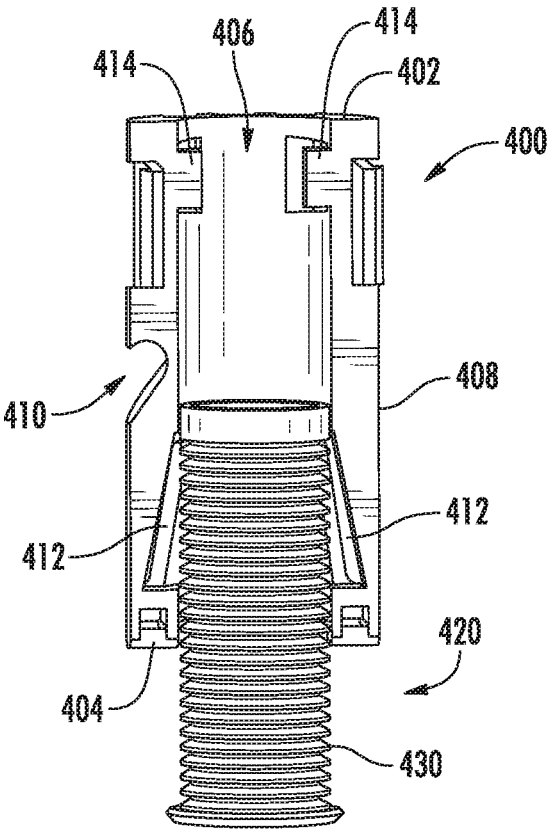
FIG. 8 is a partial cross-section view of the cord tether and cord tensioner shown in FIG. 7, the cross-sectional view of the cord tether taken along line VIII-VIII in FIG. 7.
Figure 9:
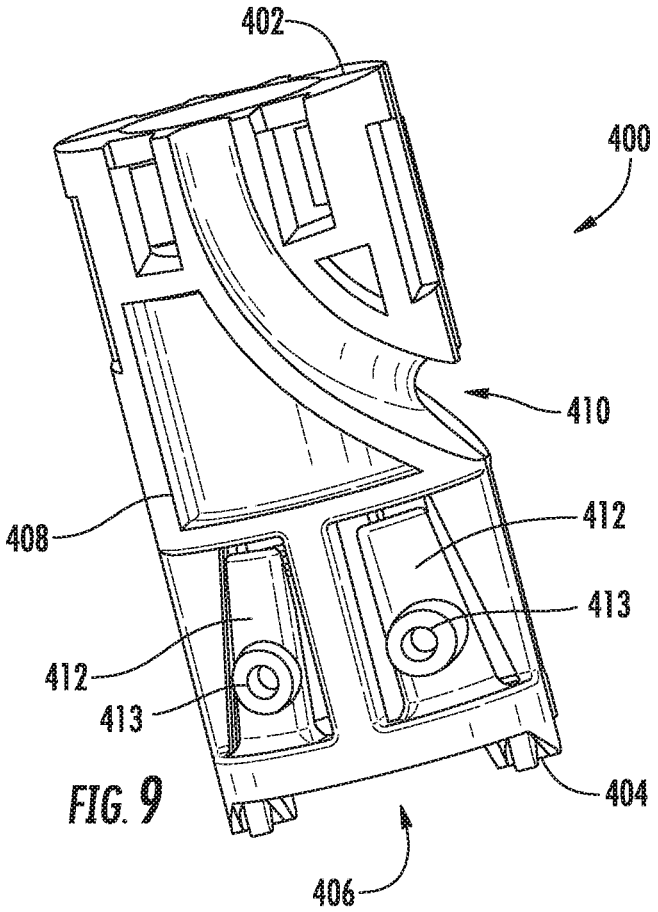
FIG. 9 is a perspective view of the cord tether shown in FIG. 7.

As previously mentioned, the operating cord 212 may be coupled to the outer wand 330 by any now known or hereafter developed mechanism for preventing relative rotation (e.g., twisting) between the operating cord 212 and the outer wand 330 while enabling the operating cord 212 to be manipulated (e.g., pulled) by the user to move the covering 30 between the extended and retracted positions. Referring to FIGS. 4, 7-10, and 16, in one example of an embodiment, the integrated wand assembly 200 includes a cord tether 400. As best shown in FIGS. 7-9, the cord tether 400 includes a top end 402, a bottom end 404, and a bore 406 extending from the top end 402 to the bottom end 404 for enabling the outer wand 330 and the inner wand 310 to pass therethrough. In addition, as shown, the cord tether 400 further includes an outer surface 408 extending between the top and bottom ends 402, 404, and a pathway 410 formed in the outer surface 408 for receiving and guiding the operating cord 212. Thus arranged, the operating cord 212 is shifted or moved to one side of the outer wand 330. That is, the operating cord 212 (e.g., the bottom of the loop) is guided by the cord tether 400 from being positioned along opposing sides of the outer wand 330 to being positioned in front of the outer wand 330 (e.g., cord tether 400 includes, for example, a semi-grooved or U-shaped channel or pathway 410 formed in the outer surface 408 thereof to shift or move the operating cord 212 to one side of the outer wand 330). That is, the operating cords 212 are positioned with one cord or with one side of the loop of the operating cord 212 positioned on either side of the outer wand 330. Thus arranged, the opposing loops of the operating cord 212 are balanced along the length of the outer wand 330 so that the wand assembly 200 stays in place when the operating cords 212 are placed in tension (e.g., symmetry of the operating cords 212 about the outer wand 330 assists the manufacturer during fabrication in preventing the longitudinal axis of the outer wand 330 from kicking out. In use, the symmetry of the operating cords 212 about the outer wand 330 also assists in enabling the wand assembly 200 to return to a vertically orientated position while maintaining the tension in the operating cords 212 set during fabrication). The pathway 410 formed in the cord tether 400 transitions, passes, moves, etc. the operating cord 212 to one side of the outer wand 330 to enable the operating cord 212 to circumvent or avoid the outer wand 330.

In addition, for reasons that will become apparent later on, the cord tether 400 may include one or more inwardly extending projections or leaf-spring type members 412 for mating with a cord tensioner 420.

The cord tether 400 is coupled to the outer wand 330. That is, the cord tether 400 is coupled to the outer wand 330 to prevent relative rotation between the cord tether 400 and the outer wand 330. The cord tether 400 may be coupled to the outer wand 330 by any suitable mechanism now known or hereafter developed. For example, in one embodiment, the cord tether 400 may be keyed to the outer wand 330. Referring to FIGS. 4 and 8, the cord tether 400 may include one or more inwardly extending ribs, keys, projections, etc. 414 for mating with one or more slots or grooves 334 (FIG. 15) formed in the outer wand 330 to prevent relative rotation of the cord tether 400 and the outer wand 330. That is, as shown in FIG. 15, the outer wand 330 may include diametrically opposed slots or grooves 334 extending from a lower end 332 thereof. The cord tether 400 may include diametrically opposed ribs 414 arranged and configured to mate with the diametrically opposed slots or grooves 334 formed in the outer wand 330. Thus arranged, by keying the cord tether 400 to the outer wand 330, the cord tether 400 is coupled to the outer wand 330, and thus the operating cord 212 is prevented from twisting, spinning, etc. relative to the outer wand 330 when the handle portion 360, and hence the inner wand 310, is rotated relative to the outer wand 330.

As shown, the cord tether 400 may be manufactured from first and second components that are coupled together via any suitable mechanism now known or hereafter developed including, for example, interlocking projections and recesses, snap-fit connection, an adhesive, etc. Alternatively, the cord tether 400 may be manufactured from more or fewer components.

Referring to FIGS. 4, 7, 8, 10 and 16, in accordance with another separate and distinct aspect of the present disclosure that may be used separately from, or in combination with, the other aspects of the integrated wand assembly 200 disclosed herein, the handle assembly 350 may include a cord tensioner 420. That is, as will be described herein, the handle assembly 350 may include a cord tensioner 420 that may be used in combination with the cord tether 400 to tension the operating cord 212 into a taut condition. It is envisioned that such a device and/or method may be used in connection with other now known or hereafter developed architectural-structure coverings. For example, it is envisioned that the cord tensioner may be used to tension the operating cords of an architectural-structure covering that does not incorporate a tilting function and/or that does not extend horizontally.

Figure 10:
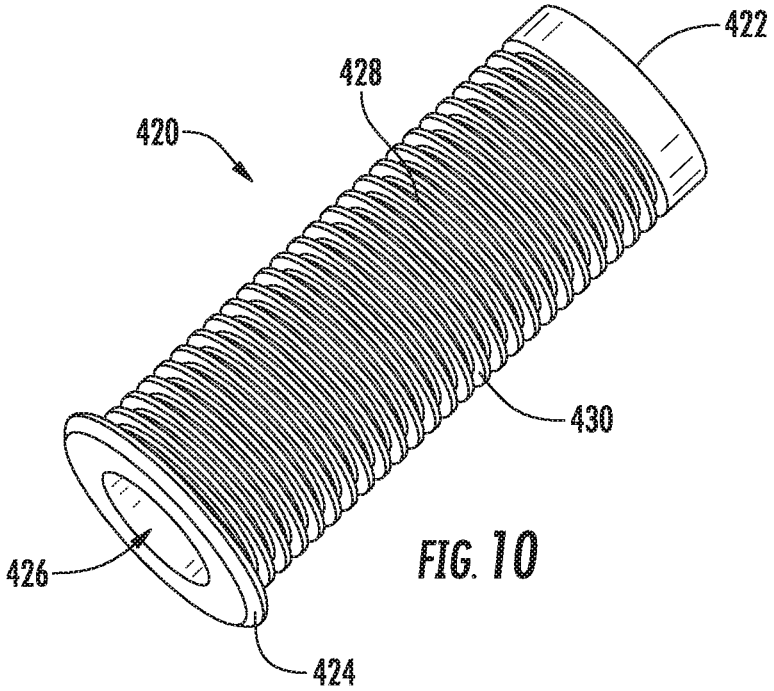
FIG. 10 is a perspective view of the cord tensioner shown in FIG. 7.

Referring to FIG. 10, in one example of an embodiment, the cord tensioner 420 includes a top end 422, a bottom end 424, a bore 426 extending from the top end 422 to the bottom end 424 so that the inner wand 310 may pass therethrough, and an outer surface 428 arranged and configured to selectively (e.g., ratchetedly) couple to the cord tether 400. That is, as shown, the outer surface 428 of the cord tensioner 420 includes a plurality of ridges, rings, projections, rachets, etc. 430 (used interchangeably herein without the intent to limit) for coupling, interacting with, etc., for example, the inwardly extending projections 412 formed on the cord tether 400. In use, the ridges 430 formed on the outer surface 428 of the cord tensioner 420 and the corresponding inwardly extending projections 412 formed on the cord tether 400 are arranged and configured to prevent, or at least minimize, back-driving of the cord tensioner 420 relative to the cord tether 400 so that, once set, the position of the cord tensioner 420 relative to the cord tether 400 is maintained.

As shown in FIGS. 7 and 9, in one example of an embodiment, the inwardly extending projections 412 may include, for example, an opening, annular boss, or the like 413. In use, the bosses 413 are arranged and configured to receive a tool (not shown), which can be used to deflect the inwardly extending projections 412 so that the inwardly extending projections 412 disengage from the ridges 430 formed on the cord tensioner 420, and thereby enable the tension in the operating cords 212 to be relaxed if necessary.

The cord tensioner 420 however may take on other forms. For example, in one example of an alternate embodiment, the ridges 430 may be helical (e.g., screw threads). Thus arranged, tension can be applied to the operating cords 212 by rotating the cord tensioner 420 with respect to the cord tether 400. Once tension has been set, an assembly for preventing relative rotation of the cord tensioner 420 relative to the cord tether 400 may be provided to prevent further, inadvertent rotation. In use, the assembly for preventing rotation could be any now known or hereafter developed assembly including, for example, a clip, a pin, or some other assembly for securing the position of the cord tensioner 420 relative to the cord tether 400. By providing a helical cord tensioner 420 increased, fine tuning of the operating cords 212 could be achieved. If needed, the tension in the operating cords 212 could be relaxed by removing the assembly for preventing relative rotation, and then rotating the cord tensioner 420 in an opposite direction.

Referring to FIG. 16, the cord tensioner 420 is coupled to or operatively associated with the inner wand 310 so that once properly positioned, the cord tensioner 420 is prevented from moving axially upwards relative to the inner wand 310. The cord tensioner 420 may be prevented from moving axially upwards relative to the inner wand 310 by any suitable mechanism now known or hereafter developed. For example, in one example of an embodiment, the cord tensioner 420 may be prevented from moving axially upwards relative to the inner wand 310 via a transverse cross-pin 435 extending through the inner wand 310. In use, contact of the top end 422 of the cord tensioner 420 against the transverse cross-pin 435 prevents upward axial movement of the cord tensioner 420. That is, referring to FIG. 16, the inner wand 310 includes an upper transverse cross-pin 435 extending therethrough for preventing upward, axial movement of the cord tensioner 420 relative to the inner wand 310 (e.g., the transverse cross-pin 435 passes through the inner wand 310 to contact the top end 422 of the cord tensioner 420). Thus arranged, with the cord tether 400 keyed to the outer wand 330, the operating cord 212 passing through the pathway 410 formed in the outer surface 408 of the cord tether 400, and the cord tensioner 420 selectively coupled to the cord tether 400 with the top end 422 of the cord tensioner 420 in contact with the transverse cross-pin 435, movement such as, for example, downward movement of the cord tether 400 relative to the cord tensioner 420 causes the operating cord 212 to be tensioned to prevent, or at least minimize, slacking in the operating cord 212.

That is, the cord tether 400 includes one or more inwardly extending projections, leaf-springs, etc. 412 for selectively coupling to the ridges 430 formed on the outer surface 428 of the cord tensioner 420 to enable the cord tether 400 to selectively move relative to the cord tensioner 420 to tension the operating cords 212 coupled to the cord tether 400. That is, the inwardly extending projections, leaf-springs, etc. 412 "ratchet" against the ridges 430 formed on the outer surface 428 of the cord tensioner 420. Thereafter, the cord tether 400 is held in place axially via the ridges 430.

Referring to FIGS. 3-6 and 16, the handle assembly 350 may be manufactured from multiple components or portions. For example, as illustrated, the handle assembly 350 may include the handle portion 360 and a top cap 440. As previously explained, the handle portion 360 is coupled (e.g., non-rotatably coupled) to the inner wand 310 via, for example, the handle retainer 370 and the bottom cap 380 so that rotation of the handle portion 360 is transferred to the inner wand 310 and eventually to the tilt rod 110 for rotating the covering 30 or components thereof between the open and closed configurations. The top cap 440 is arranged and configured to be rotatable relative to the handle portion 360 so that rotation of the handle portion 360 is not transferred to the top cap 440. Thus arranged, the top cap 440 is arranged and configured to remain stationary relative to the outer wand 330 while the handle portion 360, and hence the inner wand 310, are being rotated. As such, the operating cord 212, which in one example of an embodiment, passes through cutouts 450 formed in the top cap 440, remain stationary during rotation of the handle portion 360 thereby preventing, or at least minimizing, twisting of the operating cord 212 during rotation of the handle portion 360.

Figure 5:
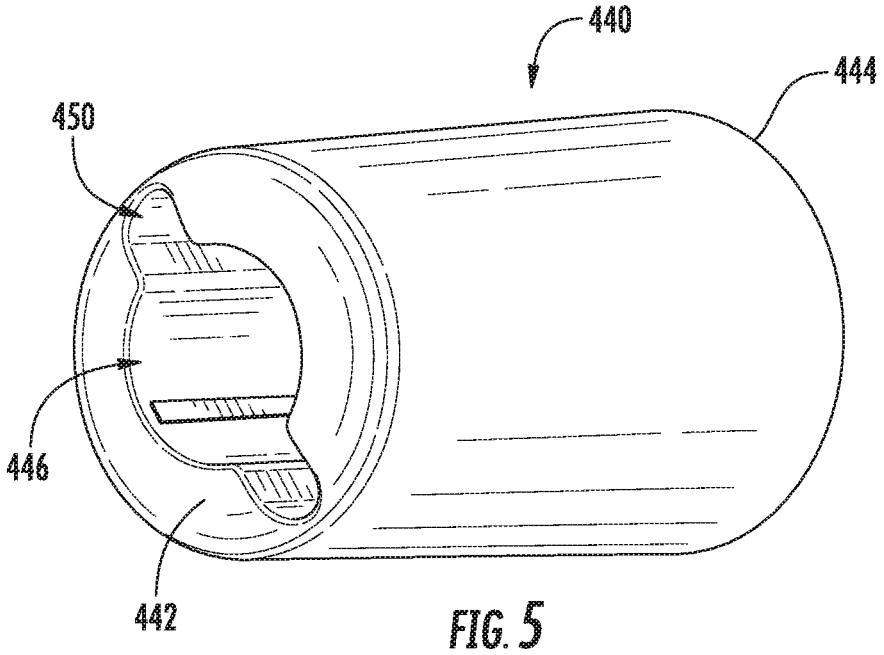
FIG. 5 is a side perspective view illustrating an example of an embodiment of a top cap used in connection with the wand assembly shown in FIG. 3.
Figure 6:
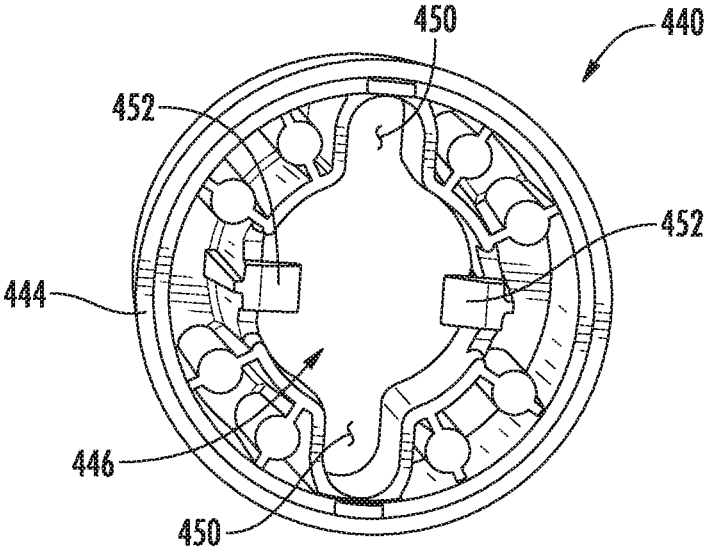
FIG. 6 is a bottom end view of the top cap shown in FIG. 5.

Referring to FIGS. 5 and 6, in one example of an embodiment, the top cap 440 includes a top end 442, a bottom end 444 arranged and configured for contacting the top end 361 (FIG. 11) of the handle portion 360, and a bore 446 extending between the top and bottom ends 442, 444 for enabling the outer and inner wands 330, 310 to pass therethrough. In one example of an embodiment, the handle portion 360 may be arranged and configured to slide over, from the bottom end, the inner wand 310, the cord tether 400, and the cord tensioner 420. Meanwhile, the top cap 440 may be arranged and configured to slide down from the top end of the outer wand 330 and the inner wand 310 to meet the handle portion 360 and to cover any opening between the handle portion 360 and the outer wand 330 (e.g., the top cap 440 is arranged and configured to contact the top end 361 of the handle portion 360 to cover any opening between the handle portion 360 and the outer wand 330).

As shown and as previously mentioned, the top end 442 of the top cap 440 may include a pair of diametrically opposed cutouts 450 for enabling the operating cord 212 to pass therethrough. Thus arranged, the cutouts 450 formed in the top cap 440 assist with guiding and positioning the operating cord 212 within the handle portion 360.

In one example of an embodiment, the top cap 440 is arranged and configured to contact the outer wand 330 so as to maintain its position relative thereto. For example, referring to FIG. 6, in one example of an embodiment, the top cap 440 may include one or more inwardly extending projections, leaf springs, etc. 452 for creating a friction fit between the top cap 440 and the outer wand 330, although other suitable mechanism are envisioned such as, for example, O-rings, etc.

Referring to FIGS. 17-21, an alternate example of an embodiment of a handle assembly 550 is shown. As will be illustrated and described herein, the handle assembly 550 is substantially similar to the handle assembly 350 previously illustrated and described in connection with FIGS. 3-16 except as illustrated and described herein. Thus, for the sake of brevity, only certain features of the handle assembly 550 will hereinafter be described. As will be described herein, the handle assembly 550 includes a handle portion 560, a handle retainer 570, a bottom cap 580, a cord tether 600, and a top cap 640. In use, in connection with the current embodiment, the cord tether 600 is arranged and configured to couple to the handle retainer 570 (e.g., without any intervening cord tensioner).

Figure 17:
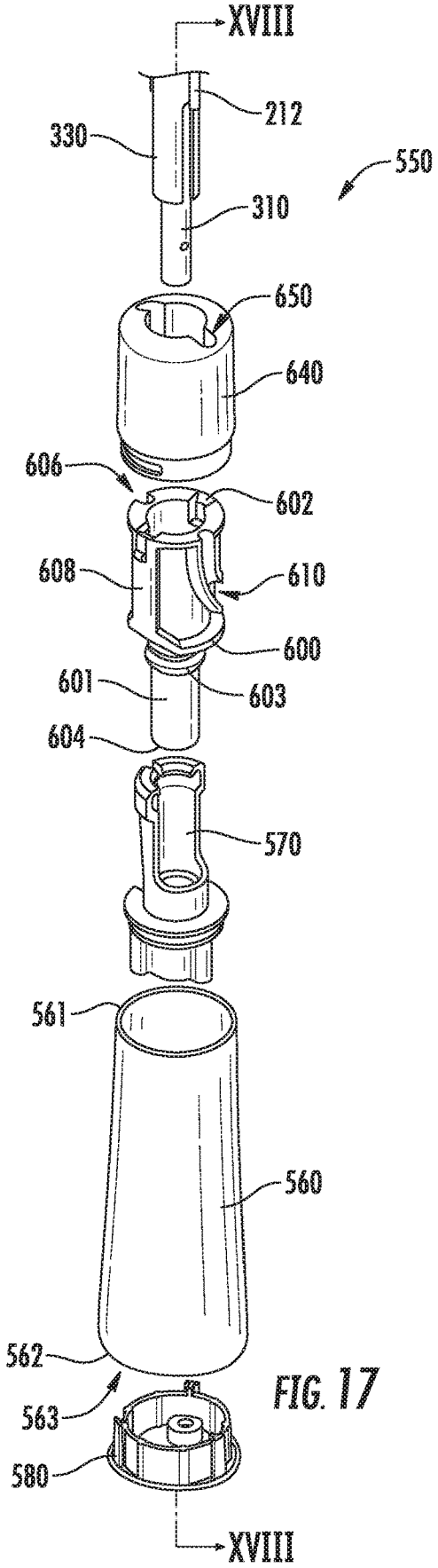
FIG. 17 is an exploded, perspective view of an alternate example of an embodiment of a handle assembly that may be used in conjunction with the wand assembly of FIGS. 1 and 3.
Figure 18:
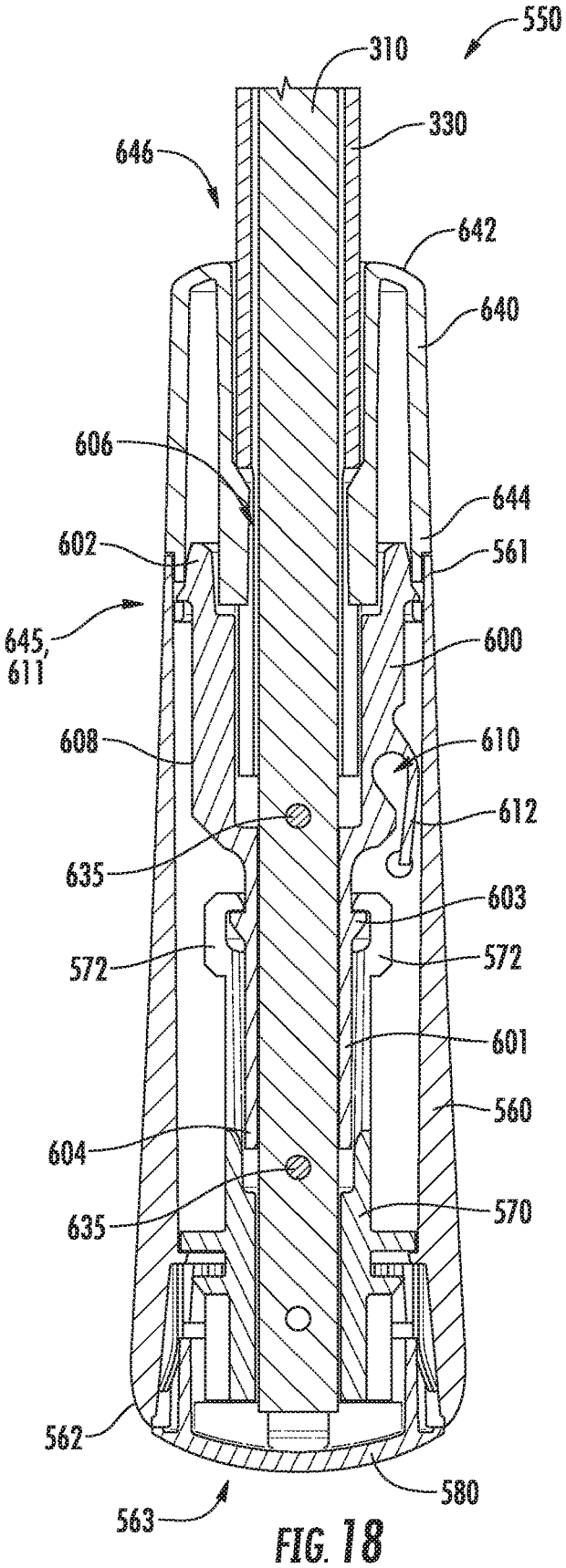
FIG. 18 is a cross-section view of the handle assembly shown in FIG. 17, the cross-sectional view taken along line XVIII-XVIII in FIG. 17.

As illustrated, the handle assembly 550 includes a handle or gripping portion 560. In use, the handle portion 560 is operatively coupled to an inner wand such as, for example, inner wand 310 so that rotation of the handle portion 560 rotates the inner wand 310, and hence the tilt rod 110 and the covering 30, or components thereof, between the open and closed configurations. As previously described, the handle portion 560 is decoupled (e.g., not engaged or coupled) from an outer wand, such as, for example, the outer wand 330 so that rotation of the handle portion 560 does not rotate, affect, manipulate, etc. the outer wand 330. Thus arranged, rotation of the handle portion 560 and hence the inner wand 310 is not transferred to the outer wand 330, and hence to the operating cord 212, thus preventing, or at least minimizing, twisting of the operating cord 212 about the outer wand 330. Referring to FIGS. 17 and 18, the handle portion 560 includes a top end 561, a bottom end 562, and a bore 563 extending between the top and bottom ends 561, 562.

The handle portion 560 may be coupled to the inner wand 310 by any now known or hereafter developed mechanism for achieving the function, result, and/or operation described herein. As illustrated, in one example of an embodiment, the handle assembly 550 may include a handle retainer 570 and a bottom cap 580. As will be described in greater detail below, the handle retainer 570 and the bottom cap 580 are coupled to the handle portion 560 and to the inner wand 310 so that rotation of the handle portion 560 rotates the handle retainer 570, the bottom cap 580, and the inner wand 310 to move the tilt rod 110, which moves the covering 30 between the open and closed configurations for adjusting the amount of view through. In one example of an embodiment, as will be described in greater detail below, the handle portion 560 (e.g., the bore 563) is arranged and configured so that movement of the handle portion 560 does not affect movement of the elements of the handle assembly 550 other than engagement with the inner wand 310 via the handle retainer 570 and the bottom cap 580 so that the handle portion 560 can rotate without affecting (e.g., twisting) the operating cord 212. That is, the handle portion 560 is arranged and configured so that movement of the handle portion 560 is not transferred to the outer wand 330 or the cord tether 600 such that rotation of the handle portion 560 is not transferred to the operating cord 212.

In one example of an embodiment, the bottom cap 580 is arranged and configured to close the bottom end 562 of the handle portion 560. In addition, and/or alternatively, the bottom cap 580 may be keyed to the bottom end 562 of the handle portion 560 so that rotation of the handle portion 560 rotates the bottom cap 580 in unison. In addition, the bottom cap 580 may be coupled to the handle retainer 570. For example, the bottom cap 580 may be coupled to the handle retainer 570 by fasteners such as, for example, screws, although other mechanisms for coupling the bottom cap 580 to the handle retainer 570 is envisioned such as, for example, a snap-fit connection. As previously mentioned, the handle retainer 570 may include a plurality of channels for receiving fasteners that pass-through openings 582 (FIG. 19) formed in the bottom cap 580. In addition, the handle retainer 570 may be non-rotatably coupled to the inner wand 310. For example, the bore formed in the handle retainer 570 may be keyed to a non-circular portion of the inner wand and/or a transverse cross-pin may be utilized to couple the handle retainer 570 to the inner wand 310. Thus arranged, the handle portion 560 is coupled to the inner wand 310 via the bottom cap 580 and the handle retainer 570 so that, in use, manipulation (e.g., rotation) of the handle portion 560 is transferred to the inner wand 310.

In addition, and/or alternatively, the bottom cap 580 may be coupled to the inner wand 310. For example, the bottom cap 580 may be coupled to the inner wand 310 via a transverse cross-pin, although other mechanisms for coupling the bottom cap 580 to the inner wand 310 may be utilized.

In addition, and/or alternatively, the handle portion 560 and the handle retainer 570 may include one or more alignment features to align and guide insertion of the handle retainer 570 within the bore 563 of the handle portion 560. For example, in one example of an embodiment, the handle portion 560, the handle retainer 570, and/or the bottom cap 580 may include corresponding projections, grooves, ridges, ledges, or the like to align and guide insertion of the handle retainer 570 and/or the bottom cap 580 within the bore 563 of the handle portion 560. For example, in use, the handle portion 560 and the handle retainer 570 may include a keyway to align a portion of the handle portion 560 (e.g., to align a flat portion of the handle portion 560).

As illustrated and as previously mentioned, the wand assembly 550 includes a cord tether 600. In the illustrated example of an embodiment, the cord tether 600 includes an elongated stem 601. In use, the handle retainer 570 may be arranged and configured to couple to the cord tether 600. For example, in the illustrated example of an embodiment, the elongated stem 601 of the cord tether 600 may include one or more projections, ridges, ledges, or the like 603. The handle retainer 570 may include one or more flexible arms 572 arranged and configured to flex to receive and engage the one or more projections, ridges, ledges, or the like 603 in a snap-fit arrangement, although other coupling mechanisms for coupling the handle retainer 570 to, for example, the cord tether 600 are envisioned.

Figure 19:
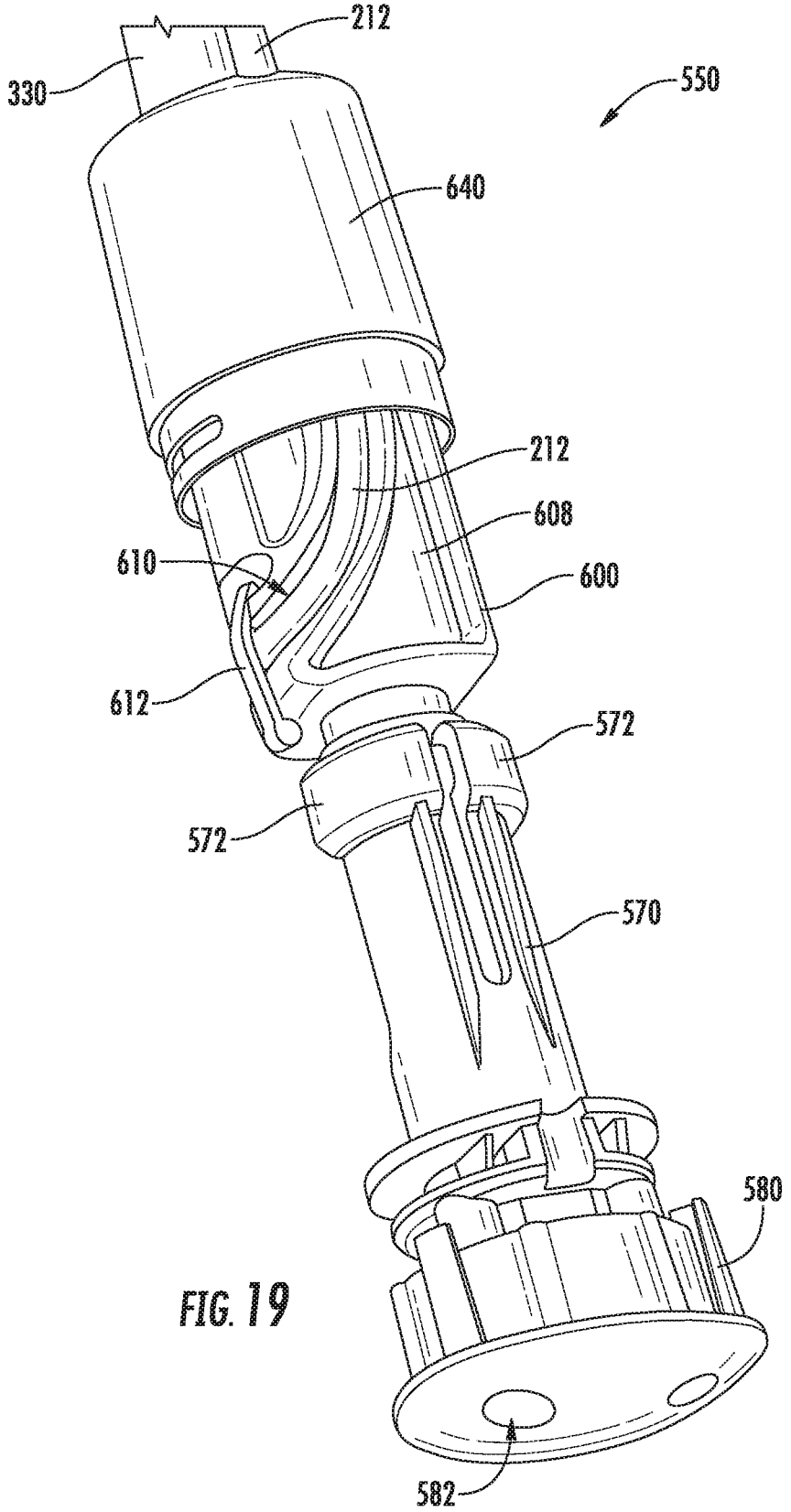
FIG. 19 is a partial, perspective view of the handle assembly shown in FIG. 17, the handle assembly shown with the handle portion omitted for clarity.
Figure 20:
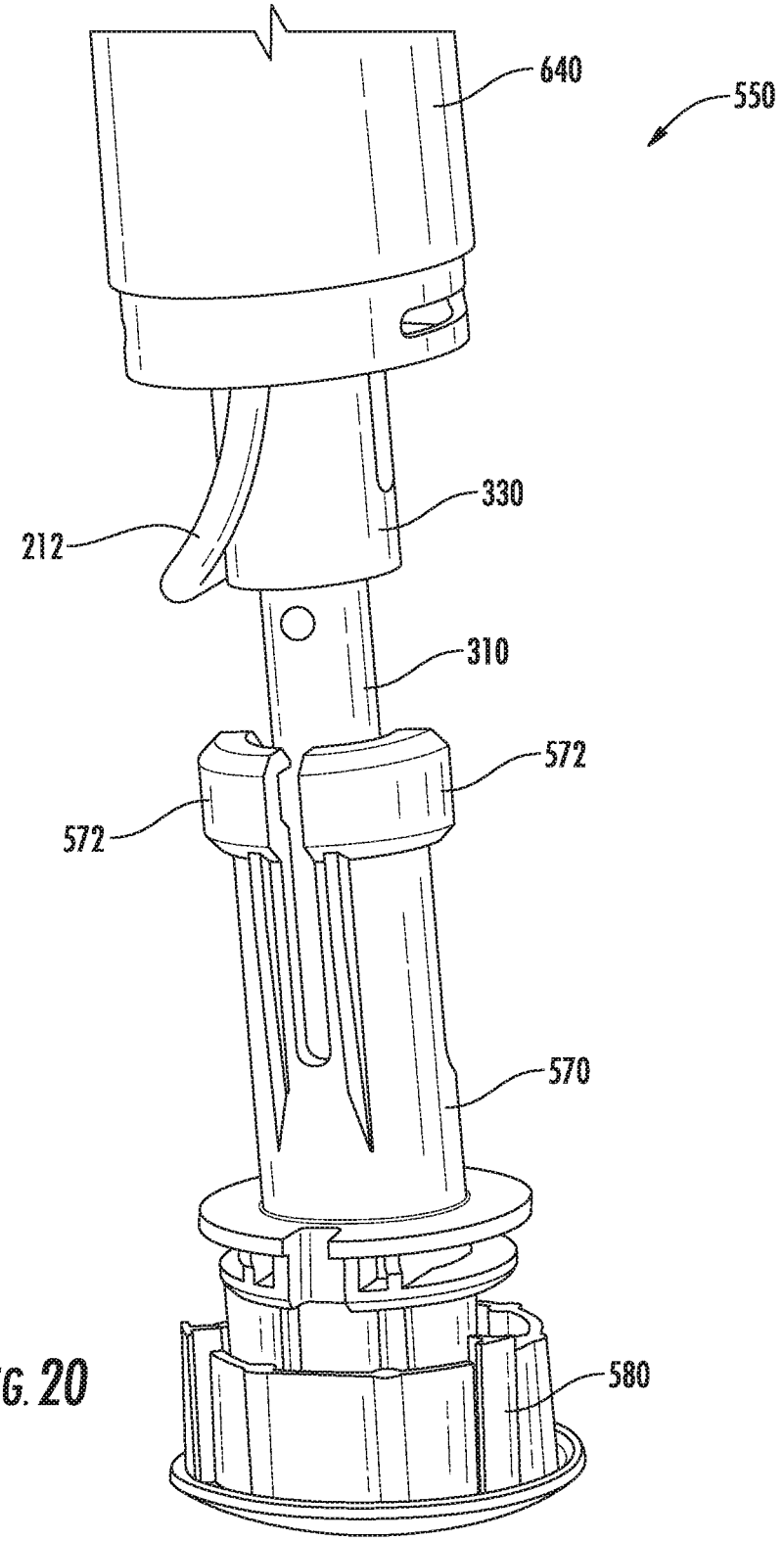
FIG. 20 is a partial, perspective view of the handle assembly shown in FIG. 17, the handle assembly shown with the handle portion and the cord tether omitted for clarity.
Figure 21:
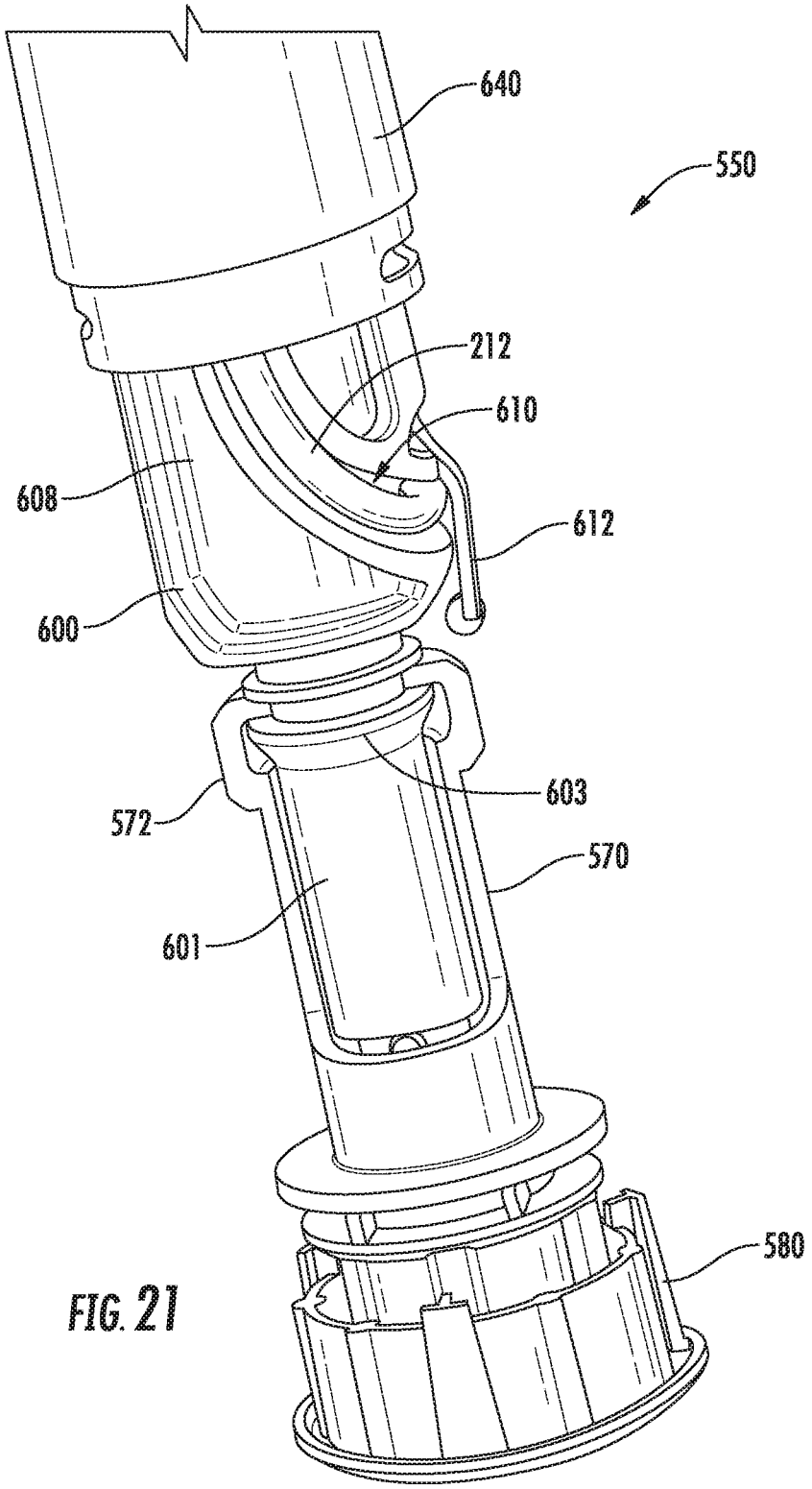
FIG. 21 is a partial, perspective view of the handle assembly shown in FIG. 17, the handle assembly shown with the handle portion omitted for clarity.

In use, as previously mentioned, the cord tether 600 includes a top end 602, a bottom end 604, and a bore 606 extending from the top end 602 to the bottom end 604 for enabling the outer wand 330 and the inner wand 310 to pass therethrough (FIG. 18). In addition, as shown, the cord tether 600 further includes an outer surface 608 extending between the top and bottom ends 602, 604, and a pathway 610 formed in the outer surface 608 for receiving and guiding the operating cord 212. Thus arranged, the operating cord 212 is shifted or moved to one side of the outer wand 330, as best shown in FIG. 19. That is, the operating cord 212 (e.g., the bottom of the loop) is guided by the cord tether 600 from being positioned along opposing sides of the outer wand 330 to being positioned in front of the outer wand 330 (e.g., cord tether 600 includes, for example, a semi-grooved or U-shaped channel or pathway 610 formed in the outer surface 608 thereof to shift or move the operating cord 212 to one side of the outer wand 330). That is, the loops of the operating cord 212 are positioned with one cord or with one side of the loop of the operating cord 212 positioned on either side of the outer wand 330. Thus arranged, the opposing loops of the operating cord 212 are balanced along the length of the outer wand 330 so that the wand assembly 200 stays in place when the operating cord 212 is placed in tension (e.g., symmetry of the operating cord 212 about the outer wand 330 assists the manufacturer during fabrication in preventing the longitudinal axis of the outer wand 330 from kicking out. In use, the symmetry of the operating cord 212 about the outer wand 330 also assists in enabling the wand assembly 200 to return to a vertically orientated position while maintaining the tension in the operating cord 212 set during fabrication). The pathway 610 formed in the cord tether 600 transitions, passes, moves, etc. the operating cord 212 to one side of the outer wand 330 to enable the operating cord 212 to circumvent or avoid the outer wand 330.

In use, the cord tether 600 is coupled to the outer wand 330. That is, the cord tether 600 is coupled to the outer wand 330 to prevent relative rotation between the cord tether 600 and the outer wand 330. The cord tether 600 may be coupled to the outer wand 330 by any suitable mechanism now known or hereafter developed. For example, in one embodiment, the cord tether 600 may be keyed to the outer wand 330. Thus arranged, the cord tether 600 is coupled to the outer wand 330, and thus the operating cord 212 is prevented from twisting, spinning, etc. relative to the outer wand 330 when the handle portion 560, and hence the inner wand 310, is rotated relative to the outer wand 330.

As illustrated, in the example embodiment, transverse cross-pins 635 may be positioned through the inner wand 310. The transverse cross-pins 635 being arranged and configured to interact with the cord tether 600 to constrict axially, longitudinal movement of the cord tether 600 (e.g., the cord tether 600 is prevented from moving axially relative to the inner wand 310. Referring to FIG. 18, the inner wand 310 includes upper and lower transverse cross-pins 635 extending therethrough for preventing upward and downward, axial movement of the cord tether 600 relative to the inner wand 310 (e.g., cross-pins 635 contact top and bottom ends of the cord tether 600). Thus arranged, by properly positioning the location of the cord tether 600, the operating cord 212 may be properly tensioned in a taut condition without incorporation of a cord tensioner as previously described.

As illustrated, in one example of an embodiment, the cord tether 600 may also include a retaining arm 612. In use, the retaining arm 612 is arranged and configured to interact with the pathway 610 (e.g., to extend over and beyond the pathway 610) to prevent accidental slippage of the operating cord 212 out of the pathway 610 during, for example, assembly.

The handle assembly 550 may be manufactured from multiple components or portions. For example, as illustrated, the handle assembly 550 may include the handle portion 560 and a top cap 640. As previously explained, the handle portion 560 is coupled (e.g., non-rotatably coupled) to the inner wand 310 via, for example, the handle retainer 570 and the bottom cap 580 so that rotation of the handle portion 560 is transferred to the inner wand 310 and eventually to the tilt rod 110 for rotating the covering 30 or components thereof between the open and closed configurations. The top cap 640 is arranged and configured to be rotatable relative to the handle portion 560 so that rotation of the handle portion 560 is not transferred to the top cap 640. Thus arranged, the top cap 640 is arranged and configured to remain stationary relative to the outer wand 330 while the handle portion 560, and hence the inner wand 310, are being rotated. As such, the operating cord 212, which in one example of an embodiment, passes through cutouts 650 formed in the top cap 640, remain stationary during rotation of the handle portion 560 thereby preventing, or at least minimizing, twisting of the operating cord 212 during rotation of the handle portion 560.

Similar to the top cap 440 previously described, top cap 640 includes a top end 642, a bottom end 644 arranged and configured for contacting the top end 561 of the handle portion 560, and a bore 646 extending between the top and bottom ends 642, 644 for enabling the outer and inner wands 330, 310 to pass therethrough (FIG. 18). In one example of an embodiment, the handle portion 560 may be arranged and configured to slide over, from the bottom end, the inner wand 310 and the cord tether 600. Meanwhile, the top cap 640 may be arranged and configured to slide down from the top end of the outer wand 330 and the inner wand 310 to meet the handle portion 560 and to cover any opening between the handle portion 560 and the outer wand 330 (e.g., the top cap 640 is arranged and configured to contact the top end 561 of the handle portion 560 to cover any opening between the handle portion 560 and the outer wand 330).

As previously mentioned, the top end 642 of the top cap 640 may include a pair of diametrically opposed cutouts 650 (FIG. 17) for enabling the operating cord 212 to pass therethrough. Thus arranged, the cutouts 650 formed in the top cap 640 assist with guiding and positioning the operating cord 212 within the handle portion 560.

Referring to FIG. 18, the top cap 640 may include an opening, a slot, or the like 645 for receiving a corresponding projection 611 formed on the cord tether 600 for coupling the cord tether 600 to the top cap 640, although other coupling mechanisms are envisioned.

Figure 22:
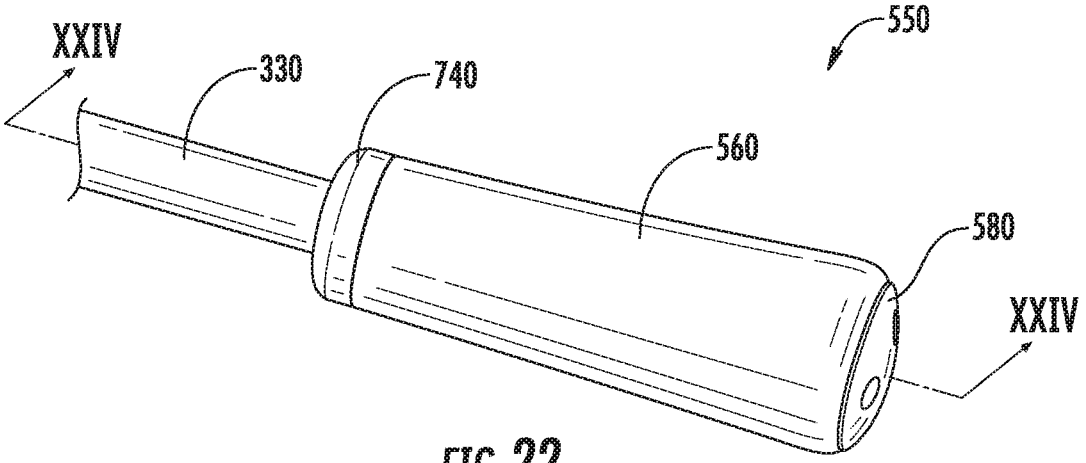
FIG. 22 is a perspective view of an alternate example of an embodiment of a handle assembly that may be used in conjunction with the wand assembly of FIGS. 1 and 3.
Figure 23:
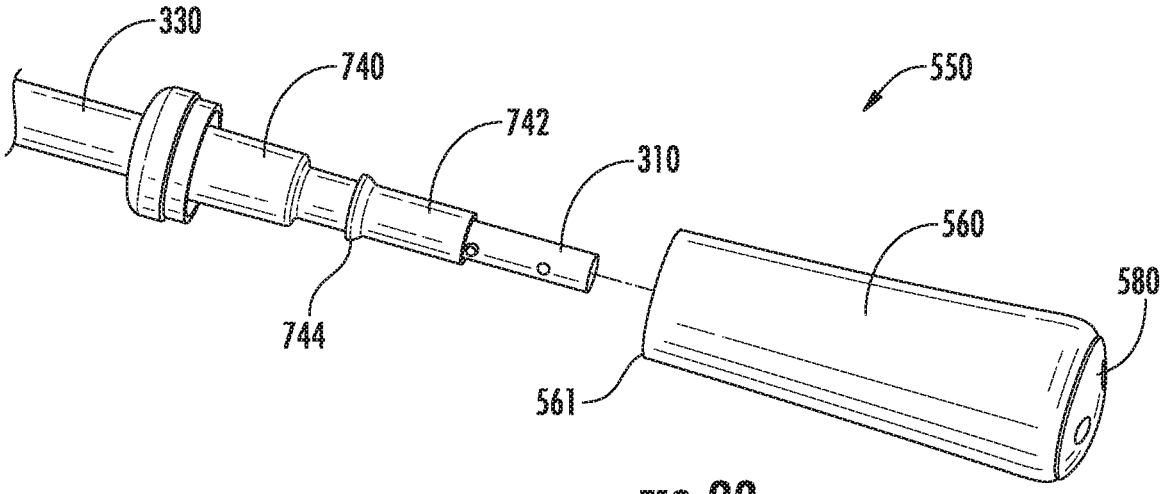
FIG. 23 is a partial, exploded perspective view of the handle assembly shown in FIG. 22.
Figure 24:
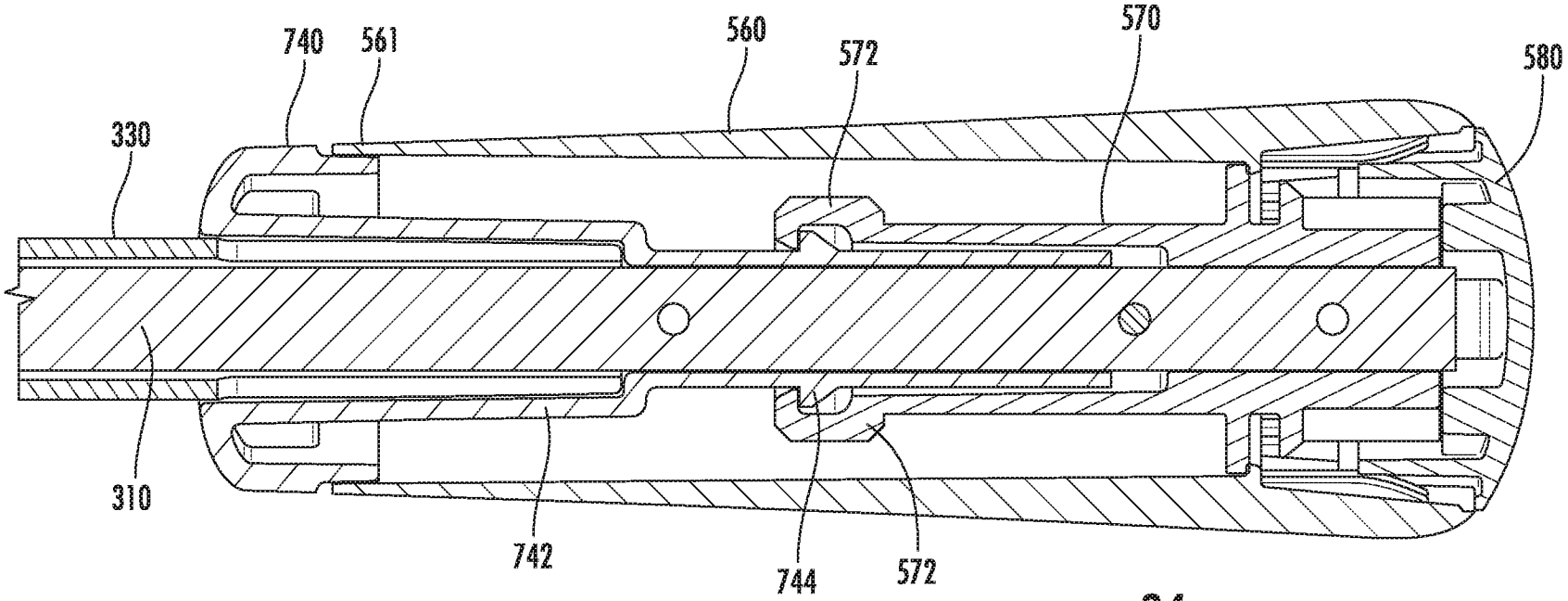
FIG. 24 is a cross-section view of the handle assembly shown in FIG. 22, the cross-sectional view taken along line XXIV-XXIV in FIG. 22.

Alternatively, referring to FIGS. 22-24, an alternate example of an embodiment of a top cap 740 is shown. In use, the top cap 740 may be used in the handle assembly 550 shown and described in connection with FIGS. 17-21. In particular, the top cap 740 may be used in place of top cap 640 when the wand assembly is in the form of a traveling wand assembly. As will be appreciated by one of ordinary skill in the art, a traveling wand assembly is movably positioned along a horizontal length of the head rail assembly to move the covering between the extended and retracted positions (e.g., a traveling wand assembly does not include an operating cord).

In use, the top cap 740 may be coupled to the hand assembly 550. For example, in the illustrated example of an embodiment, the cord tether may be removed from the handle assembly 550 and the top cap 740 may be coupled directly to the handle retainer 570 via a snap-fit connection, although other coupling mechanisms for coupling the top cap 740 to the handle assembly 550 may be utilized. For example, in the illustrated example embodiment, the top cap 740 may include an elongated stem portion 742 including one or more projections, ridges, ledges, or the like 744. The handle retainer 570 may include one or more flexible arms 572 arranged and configured to flex to receive and engage the one or more projections, ridges, ledges, or the like 744 formed on the stem portion 742 of the top cap 740 in a snap-fit arrangement.

In use, the top cap 740 may be arranged and configured to contact the outer wand 330 to cover or conceal any opening between the handle portion 560 and the outer wand 330 (e.g., the top cap 740 is arranged and configured to contact the top end 561 of the handle portion 560 to cover any opening between the handle portion 560 and the outer wand 330).

In contrast to the previously described top caps, the top cap 740 of the traveling wand assembly may be devoid of any cutouts since the operating cord is no longer present. Thus arranged, the top cap 740 is arranged and configured to provide a sleek, reduced profile (e.g., a more reduced portfolio top cap may be provided).

In one embodiment, a vertical architectural-structure covering is disclosed. The vertical architectural-structure covering comprises a head rail assembly, a control system, a covering, an operating cord, and an integrated wand assembly. The control system is at least partially positionable within the head rail assembly, the control system includes a tilt rod and a plurality of carriers. The covering is operatively coupled to the plurality of carriers. The covering is movable between an extended position and a retracted position, and between an open configuration and a closed configuration. The operating cord is coupled to the plurality of carriers arranged and configured to move the covering between the extended and retracted positions. The integrated wand assembly is arranged and configured to actuate the control system to move the plurality of carriers relative to the head rail assembly so that the covering is movable between the extended and retracted positions, and arranged and configured to rotate the tilt rod so that the covering is movable between the open and closed configurations. The integrated wand assembly includes an outer wand, an inner wand, and a handle assembly. The operating cord extends along the outer wand. The inner wand is operatively coupled with the tilt rod, the inner wand is rotatable relative to the outer wand so that rotation of the inner wand is not transferred to the outer wand. The handle assembly includes a handle portion, the handle portion is non-rotatably coupled to the inner wand so that rotation of the handle portion rotates the inner wand to move the covering between the open and closed configurations.

In an alternate embodiment, an integrated wand assembly arranged and configured to be used with a vertical architectural-structure covering is disclosed. The vertical architectural-structure covering includes a covering, an operating cord, and a control system having a tilt rod and a plurality of carriers. The covering is operatively coupled to the plurality of carriers. The covering is movable between an extended position and a retracted position, and between an open configuration and a closed configuration. The operating cord is operatively coupled to the plurality of carriers to move the covering between the extended and retracted positions. The integrated wand assembly comprises an outer wand, an inner wand, and a handle assembly. At least a portion of the operating cord extends along the outer wand. The inner wand is operatively coupled with the tilt rod, the inner wand is rotatable relative to the outer wand so that rotation of the inner wand is not transferred to the outer wand. The handle assembly includes a handle portion, the handle portion is non-rotatably coupled to the inner wand so that rotation of the handle portion rotates the inner wand to move the covering between the open and closed configurations.

In one or more embodiments, the outer wand is non-rotatably coupled with the operating cord.

In one or more embodiments, the handle assembly further comprises a handle retainer and a bottom cap arranged and configured to non-rotatably couple the handle portion to the inner wand.

In one or more embodiments, the handle portion includes a top end, a bottom end, and a bore extending between the top and bottom ends, the bottom cap being arranged and configured to close the bottom end of the handle portion.

In one or more embodiments, the bottom cap is keyed to the bore of the handle portion so that rotation of the handle portion rotates the bottom cap.

In one or more embodiments, the bottom cap is coupled to the handle retainer.

In one or more embodiments, the bottom cap is coupled to the inner wand.

In one or more embodiments, the bottom cap is coupled to the inner wand via a transverse cross-pin passing through the bottom cap and the inner wand.

In one or more embodiments, the bore of the handle portion includes one or more alignment grooves and the handle retainer includes one or more outwardly extending ribs arranged and configured to mate with the one or more alignment grooves, respectively.

In one or more embodiments, the handle portion includes an inwardly extending ledge, the handle retainer includes one or more tangs arranged and configured to couple to the inwardly extending ledge for coupling the handle retainer to the handle portion.

In one or more embodiments, the integrated wand assembly further comprises a cord tether non-rotatably coupled to the outer wand, the cord tether including: a top end; a bottom end; an outer surface extending between the top and bottom ends; and a pathway formed in the outer surface arranged and configured to receive and guide the operating cord.

In one or more embodiments, the pathway guides the operating cord from opposing sides of the outer wand to one side of the outer wand.

In one or more embodiments, the pathway includes a U-shaped pathway arranged and configured to guide the operating cord from opposing sides of the outer wand to one side of the outer wand.

In one or more embodiments, the cord tether is keyed to the outer wand.

In one or more embodiments, the handle assembly further comprises a cord tensioner selectively coupled to the cord tether, the cord tensioner being arranged and configured to tension the operating cord.

In one or more embodiments, the cord tether includes one or more inwardly extending projections; and the cord tensioner includes a plurality of ridges formed on an outer surface thereof, the plurality of ridges being arranged and configured to couple the one or more inwardly extending projections to selectively, axially position the cord tensioner relative to the cord tether.

In one or more embodiments, the cord tether includes a bore extending from the top end thereof to the bottom end thereof, the bore being arranged and configured to allow the inner and outer wands to pass therethrough; and the cord tensioner includes a top end, a bottom end, a bore extending from the top end to the bottom end so that the inner wand passes therethrough.

In one or more embodiments, the cord tensioner is mounted so that axial movement of the cord tensioner relative to the inner wand is prevented.

In one or more embodiments, the inner wand includes a transverse bore arranged and configured to receive a transverse cross-pin passing therethrough, the top end of the cord tensioner contacting the transverse cross-pin so that upward, axial movement of the cord tensioner relative to the inner wand is prevented.

In one or more embodiments, movement of the cord tether relative to the cord tensioner tensions the operating cord.

In one or more embodiments, the handle assembly further comprises a top cap, the top cap including diametrically opposed cutouts arranged and configured to enable the operating cord to pass therethrough, the top cap being rotatable relative to the handle portion.

In one or more embodiments, the integrated wand assembly is arranged and configured for single-handed operation.

In one or more embodiments, the handle portion is arranged and configured so that rotation of the handle portion rotates the tilt rod to move the covering between the open and closed configurations while preventing twisting of the operating cord about the outer wand.

In another embodiment, an integrated wand assembly arranged and configured to be used with a vertical architectural-structure covering is disclosed. The vertical architectural-structure covering includes a covering, an operating cord, and a control system having a tilt rod and a plurality of carriers. The covering is operatively coupled to the plurality of carriers, the covering is movable between an extended position and a retracted position, and between an open configuration and a closed configuration. The operating cord is operatively coupled to the plurality of carriers to move the covering between the extended and retracted positions. The integrated wand assembly comprises a first member, a second member, and a handle assembly. At least a portion of the operating cord extends along the first member. The second member is operatively coupled with the tilt rod. The handle assembly includes a handle portion, a first coupling mechanism arranged and configured to couple to the first member, and a second coupling mechanism arranged and configured to couple to the second member. The first coupling mechanism is separate and distinct from the second coupling mechanism so that manipulation of the handle portion rotates the second member to move the covering between the open and closed configurations but does not affect the first member so that rotation of the handle portion is not transferred to the first member to thereby prevent twisting of the operating cord about the first member.

In one embodiment, the first member is an outer wand and the second member is an inner wand received within the outer wand.

In one embodiment, the handle portion is non-rotatably coupled to the second member so that rotation of the handle portion rotates the second member to move the covering between the open and closed configurations.

In one embodiment, the second coupling mechanism includes a handle retainer and a bottom cap arranged and configured to non-rotatably couple the handle portion to the second member.

In one embodiment, the handle portion includes a top end, a bottom end, and a bore extending between the top and bottom ends, the bottom cap being arranged and configured to close the bottom end of the handle portion.

In one embodiment, wherein the bottom cap is keyed to the bore of the handle portion so that rotation of the handle portion rotates the bottom cap.

In one embodiment, the bottom cap is coupled to the handle retainer.

In one embodiment, wherein the bottom cap is coupled to the second member.

In one embodiment, the bottom cap is coupled to the second member via a transverse cross-pin passing through the bottom cap and the second member.

In one embodiment, the bore of the handle portion includes one or more alignment grooves and the handle retainer includes one or more outwardly extending ribs arranged and configured to mate with the one or more alignment grooves, respectively.

In one embodiment, the handle portion includes an inwardly extending ledge, the handle retainer includes one or more tangs arranged and configured to couple to the inwardly extending ledge for coupling the handle retainer to the handle portion.

In one embodiment, the integrated wand assembly further comprises a cord tether non-rotatably coupled to the first member, the cord tether including: a top end; a bottom end; an outer surface extending between the top and bottom ends; and a pathway formed in the outer surface arranged and configured to receive and guide the operating cord.

In one embodiment, the pathway guides the operating cord from opposing sides of the first member to one side of the first member.

In one embodiment, the pathway includes a U-shaped pathway arranged and configured to guide the operating cord from opposing sides of the first member to one side of the first member.

In one embodiment, the cord tether is keyed to the first member.

In one embodiment, the handle assembly further comprises a cord tensioner selectively coupled to the cord tether, the cord tensioner arranged and configured to tension the operating cord.

In one embodiment, the cord tether includes one or more inwardly extending projections; and the cord tensioner includes a plurality of ridges formed on an outer surface thereof, the plurality of ridges arranged and configured to couple the one or more inwardly extending projections to selectively, axially position the cord tensioner relative to the cord tether.

In one embodiment, the cord tether includes a bore extending from the top end to the bottom end thereof, the bore arranged and configured to allow the first and second members to pass therethrough; and the cord tensioner includes a top end, a bottom end, a bore extending from the top end to the bottom end thereof so that the second member passes therethrough.

In one embodiment, the cord tensioner is mounted so that axial movement of the cord tensioner relative to the second member is prevented.

In one embodiment, the second member includes a transverse bore arranged and configured to receive a transverse cross-pin passing therethrough, the top end of the cord tensioner contacting the transverse cross-pin so that upward, axial movement of the cord tensioner relative to the first member is prevented.

In one embodiment, movement of the cord tether relative to the cord tensioner tensions the operating cord.

In one embodiment, the handle assembly further comprises a top cap, the top cap including diametrically opposed cutouts arranged and configured to enable the operating cord to pass therethrough, the top cap being rotatable relative to the handle portion.

In one embodiment, the integrated wand assembly is arranged and configured for single-handed operation.

In one embodiment, the handle portion is arranged and configured so that rotation of the handle portion rotates the tilt rod to move the covering between the open and closed configurations while preventing twisting of the operating cord about the first member.

The foregoing description has broad application. Accordingly, the discussion of any embodiment is meant only to be explanatory and is not intended to suggest that the scope of the disclosure, including the claims, is limited to these example embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The term "a" or "an" entity, as used herein, refers to one or more of that entity. As such, the terms "a" (or "an"), "one or more" and "at least one" can be used interchangeably herein. The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein. The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority but are used to distinguish one feature from another. The drawings are for purposes of illustration only and the dimensions, positions, order and relative sizes reflected in the drawings attached hereto may vary.

The invention claimed is:

1. A vertical architectural-structure covering comprising:

a head rail assembly;

a control system at least partially positionable within the head rail assembly, the control system including a tilt rod and a plurality of carriers;

a covering operatively coupled to the plurality of carriers, the covering being movable between an extended position and a retracted position, and the covering being moving between an open configuration and a closed configuration;

an operating cord coupled to the plurality of carriers arranged and configured to move the covering between the extended and retracted positions; and an integrated wand assembly arranged and configured to actuate the control system to move the plurality of carriers relative to the head rail assembly so that the covering is movable between the extended and retracted positions, and arranged and configured to rotate the tilt rod so that the covering is movable between the open and closed configurations;

wherein the integrated wand assembly includes:

an outer wand, the operating cord extending along the outer wand;

an inner wand operatively coupled with the tilt rod, the inner wand being rotatable relatively to the outer wand so that rotation of the inner wand is not transferred to the outer wand; and a handle assembly including a handle portion, the handle portion is non-rotatably coupled to the inner wand so that rotation of the handle portion rotates the inner wand to move the covering between the open and closed configurations; and wherein the integrated wand assembly is arranged and configured for single-handed operation.

2. The covering of claim 1, wherein the outer wand is non-rotatably coupled with the operating cord.

3. The covering of claim 1, wherein the handle assembly further comprises a top cap, the top cap including diametrically opposed cutouts arranged and configured to enable the operating cord to pass therethrough, the top cap being rotatable relative to the handle portion.

4. The covering of claim 1, wherein the handle portion is arranged and configured so that rotation of the handle portion rotates the tilt rod to move the covering between the open and closed configurations while preventing twisting of the operating cord about the outer wand.

5. The covering of claim 1, wherein the handle assembly further comprises a handle retainer and a bottom cap arranged and configured to non-rotatably couple the handle portion to the inner wand.

6. The covering of claim 5, wherein the handle portion includes a top end, a bottom end, and a bore extending between the top and bottom ends, the bottom cap being arranged and configured to close the bottom end of the handle portion.

7. The covering of claim 6, wherein the bottom cap is keyed to the bore of the handle portion so that rotation of the handle portion rotates the bottom cap.

8. The covering of claim 5, wherein the bottom cap is coupled to the handle retainer.

9. The covering of claim 8, wherein the bottom cap is coupled to the inner wand.

10. The covering of claim 9, wherein the bottom cap is coupled to the inner wand via a transverse cross-pin passing through the bottom cap and the inner wand.

11. The covering of claim 6, wherein the bore of the handle portion includes one or more alignment grooves and the handle retainer includes one or more outwardly extending ribs arranged and configured to mate with the one or more alignment grooves, respectively.

12. The covering of claim 11, wherein the handle portion includes an inwardly extending ledge, the handle retainer includes one or more tangs arranged and configured to couple to the inwardly extending ledge for coupling the handle retainer to the handle portion.

13. The covering of claim 1, wherein the integrated wand assembly further comprises a cord tether non-rotatably coupled to the outer wand, the cord tether including:

a top end;

a bottom end;

an outer surface extending between the top and bottom ends; and a pathway formed in the outer surface arranged and configured to receive and guide the operating cord.

14. The covering of claim 13, wherein the pathway guides the operating cord from opposing sides of the outer wand to one side of the outer wand.

15. The covering of claim 14, wherein the pathway includes a U-shaped pathway arranged and configured to guide the operating cord from opposing sides of the outer wand to one side of the outer wand.

16. The covering of claim 13, wherein the cord tether is keyed to the outer wand.

17. The covering of claim 13, wherein the handle assembly further comprises a cord tensioner selectively coupled to the cord tether, the cord tensioner being arranged and configured to tension the operating cord.

18. The covering of claim 17, wherein:

the cord tether includes one or more inwardly extending projections; and the cord tensioner includes a plurality of ridges formed on an outer surface thereof, the plurality of ridges being arranged and configured to couple the one or more inwardly extending projections to selectively, axially position the cord tensioner relative to the cord tether.

19. The covering of claim 18, wherein:

the cord tether includes a bore extending from the top end thereof to the bottom end thereof, the bore being arranged and configured to allow the inner and outer wands to pass therethrough; and the cord tensioner includes a top end, a bottom end, a bore extending from the top end to the bottom end so that the inner wand passes therethrough.

20. The covering of claim 19, wherein the cord tensioner is mounted so that axial movement of the cord tensioner relative to the inner wand is prevented.

21. The covering of claim 20, wherein the inner wand includes a transverse bore arranged and configured to receive a transverse cross-pin passing therethrough, the top end of the cord tensioner contacting the transverse cross-pin so that upward, axial movement of the cord tensioner relative to the inner wand is prevented.

22. The covering of claim 20, wherein movement of the cord tether relative to the cord tensioner tensions the operating cord.

23. A vertical architectural-structure covering comprising:

a head rail assembly;

a control system at least partially positionable within the head rail assembly, the control system including a tilt rod and a plurality of carriers;

a covering operatively coupled to the plurality of carriers, the covering being movable between an extended position and a retracted position, and the covering being moving between an open configuration and a closed configuration;

an operating cord coupled to the plurality of carriers arranged and configured to move the covering between the extended and retracted positions; and an integrated wand assembly arranged and configured to actuate the control system to move the plurality of carriers relative to the head rail assembly so that the covering is movable between the extended and retracted positions, and arranged and configured to rotate the tilt rod so that the covering is movable between the open and closed configurations;

wherein the integrated wand assembly includes:

an outer wand, the operating cord extending along the outer wand;

an inner wand operatively coupled with the tilt rod, the inner wand being rotatable relatively to the outer wand so that rotation of the inner wand is not transferred to the outer wand; and a handle assembly including a handle portion, the handle portion is non-rotatably coupled to the inner wand so that rotation of the handle portion rotates the inner wand to move the covering between the open and closed configurations; and wherein the handle portion is arranged and configured so that rotation of the handle portion rotates the tilt rod to move the covering between the open and closed configurations while preventing twisting of the operating cord about the outer wand.

24. The covering of claim 23, wherein the outer wand is non-rotatably coupled with the operating cord.

25. The covering of claim 23, wherein the handle assembly further comprises a top cap, the top cap including diametrically opposed cutouts arranged and configured to enable the operating cord to pass therethrough, the top cap being rotatable relative to the handle portion.

26. The covering of claim 23, wherein the integrated wand assembly is arranged and configured for single-handed operation.

27. The covering of claim 23, wherein the handle assembly further comprises a handle retainer and a bottom cap arranged and configured to non-rotatably couple the handle portion to the inner wand.

28. The covering of claim 27, wherein the handle portion includes a top end, a bottom end, and a bore extending between the top and bottom ends, the bottom cap being arranged and configured to close the bottom end of the handle portion.

29. The covering of claim 28, wherein the bottom cap is keyed to the bore of the handle portion so that rotation of the handle portion rotates the bottom cap.

30. The covering of claim 27, wherein the bottom cap is coupled to the handle retainer.

31. The covering of claim 30, wherein the bottom cap is coupled to the inner wand.

32. The covering of claim 31, wherein the bottom cap is coupled to the inner wand via a transverse cross-pin passing through the bottom cap and the inner wand.

33. The covering of claim 28, wherein the bore of the handle portion includes one or more alignment grooves and the handle retainer includes one or more outwardly extending ribs arranged and configured to mate with the one or more alignment grooves, respectively.

34. The covering of claim 33, wherein the handle portion includes an inwardly extending ledge, the handle retainer includes one or more tangs arranged and configured to couple to the inwardly extending ledge for coupling the handle retainer to the handle portion.

35. The covering of claim 23, wherein the integrated wand assembly further comprises a cord tether non-rotatably coupled to the outer wand, the cord tether including:

a top end;

a bottom end;

an outer surface extending between the top and bottom ends; and a pathway formed in the outer surface arranged and configured to receive and guide the operating cord.

36. The covering of claim 35, wherein the pathway guides the operating cord from opposing sides of the outer wand to one side of the outer wand.

37. The covering of claim 36, wherein the pathway includes a U-shaped pathway arranged and configured to guide the operating cord from opposing sides of the outer wand to one side of the outer wand.

38. The covering of claim 35, wherein the cord tether is keyed to the outer wand.

39. A vertical architectural-structure covering comprising:

a head rail assembly;

a control system at least partially positionable within the head rail assembly, the control system including a tilt rod and a plurality of carriers;

a covering operatively coupled to the plurality of carriers, the covering being movable between an extended position and a retracted position, and the covering being moving between an open configuration and a closed configuration;

an operating cord coupled to the plurality of carriers arranged and configured to move the covering between the extended and retracted positions; and an integrated wand assembly arranged and configured to actuate the control system to move the plurality of carriers relative to the head rail assembly so that the covering is movable between the extended and retracted positions, and arranged and configured to rotate the tilt rod so that the covering is movable between the open and closed configurations;

wherein the integrated wand assembly includes:

an outer wand, the operating cord extending along the outer wand;

an inner wand operatively coupled with the tilt rod, the inner wand being rotatable relatively to the outer wand so that rotation of the inner wand is not transferred to the outer wand; and a handle assembly including a handle portion, the handle portion is non-rotatably coupled to the inner wand so that rotation of the handle portion rotates the inner wand to move the covering between the open and closed configurations, the handle assembly further comprises a top cap, the top cap including diametrically opposed cutouts arranged and configured to enable the operating cord to pass therethrough, the top cap being rotatable relative to the handle portion.

40. The covering of claim 39, wherein the outer wand is non-rotatably coupled with the operating cord.

41. The covering of claim 39, wherein the integrated wand assembly is arranged and configured for single-handed operation.

42. The covering of claim 39, wherein the handle portion is arranged and configured so that rotation of the handle portion rotates the tilt rod to move the covering between the open and closed configurations while preventing twisting of the operating cord about the outer wand.

43. The covering of claim 39, wherein the handle assembly further comprises a handle retainer and a bottom cap arranged and configured to non-rotatably couple the handle portion to the inner wand.

44. The covering of claim 43, wherein the handle portion includes a top end, a bottom end, and a bore extending between the top and bottom ends, the bottom cap being arranged and configured to close the bottom end of the handle portion.

45. The covering of claim 44, wherein the bottom cap is keyed to the bore of the handle portion so that rotation of the handle portion rotates the bottom cap.

46. The covering of claim 43, wherein the bottom cap is coupled to the handle retainer.

47. The covering of claim 46, wherein the bottom cap is coupled to the inner wand.

48. The covering of claim 47, wherein the bottom cap is coupled to the inner wand via a transverse cross-pin passing through the bottom cap and the inner wand.

49. The covering of claim 43, wherein the bore of the handle portion includes one or more alignment grooves and the handle retainer includes one or more outwardly extending ribs arranged and configured to mate with the one or more alignment grooves, respectively.

50. The covering of claim 49, wherein the handle portion includes an inwardly extending ledge, the handle retainer includes one or more tangs arranged and configured to couple to the inwardly extending ledge for coupling the handle retainer to the handle portion.

51. The covering of claim 39, wherein the integrated wand assembly further comprises a cord tether non-rotatably coupled to the outer wand, the cord tether including:

a top end;

a bottom end;

an outer surface extending between the top and bottom ends; and a pathway formed in the outer surface arranged and configured to receive and guide the operating cord.

52. The covering of claim 51, wherein the pathway guides the operating cord from opposing sides of the outer wand to one side of the outer wand.

53. The covering of claim 52, wherein the pathway includes a U-shaped pathway arranged and configured to guide the operating cord from opposing sides of the outer wand to one side of the outer wand.

54. The covering of claim 51, wherein the cord tether is keyed to the outer wand.

55. A vertical architectural-structure covering comprising:

a head rail assembly;

a control system at least partially positionable within the head rail assembly, the control system including a tilt rod and a plurality of carriers;

a covering operatively coupled to the plurality of carriers, the covering being movable between an extended position and a retracted position, and the covering being moving between an open configuration and a closed configuration;

an operating cord coupled to the plurality of carriers arranged and configured to move the covering between the extended and retracted positions; and an integrated wand assembly arranged and configured to actuate the control system to move the plurality of carriers relative to the head rail assembly so that the covering is movable between the extended and retracted positions, and arranged and configured to rotate the tilt rod so that the covering is movable between the open and closed configurations;

wherein the integrated wand assembly includes:

an outer wand, the operating cord extending along the outer wand;

an inner wand operatively coupled with the tilt rod, the inner wand being rotatable relatively to the outer wand so that rotation of the inner wand is not transferred to the outer wand; and a handle assembly including a handle portion, the handle portion is non-rotatably coupled to the inner wand so that rotation of the handle portion rotates the inner wand to move the covering between the open and closed configurations, the handle assembly further comprises a handle retainer and a bottom cap arranged and configured to non-rotatably couple the handle portion to the inner wand, wherein the bottom cap is coupled to the handle retainer and the bottom cap is coupled to the inner wand.

56. The covering of claim 55, wherein the outer wand is non-rotatably coupled with the operating cord.

57. The covering of claim 55, wherein the bottom cap is coupled to the inner wand via a transverse cross-pin passing through the bottom cap and the inner wand.

58. The covering of claim 55, wherein the handle assembly further comprises a top cap, the top cap including diametrically opposed cutouts arranged and configured to enable the operating cord to pass therethrough, the top cap being rotatable relative to the handle portion.

59. The covering of claim 55, wherein the integrated wand assembly is arranged and configured for single-handed operation.

60. The covering of claim 55, wherein the handle portion is arranged and configured so that rotation of the handle portion rotates the tilt rod to move the covering between the open and closed configurations while preventing twisting of the operating cord about the outer wand.

61. The covering of claim 55, wherein the handle portion includes a top end, a bottom end, and a bore extending between the top and bottom ends, the bottom cap being arranged and configured to close the bottom end of the handle portion.

62. The covering of claim 61, wherein the bottom cap is keyed to the bore of the handle portion so that rotation of the handle portion rotates the bottom cap.

63. The covering of claim 61, wherein the bore of the handle portion includes one or more alignment grooves and the handle retainer includes one or more outwardly extending ribs arranged and configured to mate with the one or more alignment grooves, respectively.

64. The covering of claim 63, wherein the handle portion includes an inwardly extending ledge, the handle retainer includes one or more tangs arranged and configured to couple to the inwardly extending ledge for coupling the handle retainer to the handle portion.

65. The covering of claim 55, wherein the integrated wand assembly further comprises a cord tether non-rotatably coupled to the outer wand, the cord tether including:

a top end;

a bottom end;

an outer surface extending between the top and bottom ends; and a pathway formed in the outer surface arranged and configured to receive and guide the operating cord.

66. The covering of claim 65, wherein the pathway guides the operating cord from opposing sides of the outer wand to one side of the outer wand.

67. The covering of claim 66, wherein the pathway includes a U-shaped pathway arranged and configured to guide the operating cord from opposing sides of the outer wand to one side of the outer wand.

68. The covering of claim 65, wherein the cord tether is keyed to the outer wand.

69. A vertical architectural-structure covering comprising:

a head rail assembly;

a control system at least partially positionable within the head rail assembly, the control system including a tilt rod and a plurality of carriers;

a covering operatively coupled to the plurality of carriers, the covering being movable between an extended position and a retracted position, and the covering being moving between an open configuration and a closed configuration;

an operating cord coupled to the plurality of carriers arranged and configured to move the covering between the extended and retracted positions; and an integrated wand assembly arranged and configured to actuate the control system to move the plurality of carriers relative to the head rail assembly so that the covering is movable between the extended and retracted positions, and arranged and configured to rotate the tilt rod so that the covering is movable between the open and closed configurations;

wherein the integrated wand assembly includes:

an outer wand, the operating cord extending along the outer wand;

an inner wand operatively coupled with the tilt rod, the inner wand being rotatable relatively to the outer wand so that rotation of the inner wand is not transferred to the outer wand; and a handle assembly including a handle portion, the handle portion is non-rotatably coupled to the inner wand so that rotation of the handle portion rotates the inner wand to move the covering between the open and closed configuration, the handle assembly further comprises a handle retainer and a bottom cap arranged and configured to non-rotatably couple the handle portion to the inner wand, the handle portion includes a top end, a bottom end, and a bore extending between the top and bottom ends, the bottom cap being arranged and configured to close the bottom end of the handle portion, wherein the bore of the handle portion includes one or more alignment grooves and the handle retainer includes one or more outwardly extending ribs arranged and configured to mate with the one or more alignment grooves, respectively.

70. The covering of claim 69, wherein the outer wand is non-rotatably coupled with the operating cord.

71. The covering of claim 69, wherein the bottom cap is keyed to the bore of the handle portion so that rotation of the handle portion rotates the bottom cap.

72. The covering of claim 69, wherein the handle portion includes an inwardly extending ledge, the handle retainer includes one or more tangs arranged and configured to couple to the inwardly extending ledge for coupling the handle retainer to the handle portion.

73. The covering of claim 69, wherein the handle assembly further comprises a top cap, the top cap including diametrically opposed cutouts arranged and configured to enable the operating cord to pass therethrough, the top cap being rotatable relative to the handle portion.

74. The covering of claim 69, wherein the integrated wand assembly is arranged and configured for single-handed operation.

75. The covering of claim 69, wherein the handle portion is arranged and configured so that rotation of the handle portion rotates the tilt rod to move the covering between the open and closed configurations while preventing twisting of the operating cord about the outer wand.

76. The covering of claim 69, wherein the bottom cap is coupled to the handle retainer.

77. The covering of claim 76, wherein the bottom cap is coupled to the inner wand.

78. The covering of claim 77, wherein the bottom cap is coupled to the inner wand via a transverse cross-pin passing through the bottom cap and the inner wand.

79. The covering of claim 69, wherein the integrated wand assembly further comprises a cord tether non-rotatably coupled to the outer wand, the cord tether including:

a top end;

a bottom end;

an outer surface extending between the top and bottom ends; and a pathway formed in the outer surface arranged and configured to receive and guide the operating cord.

80. The covering of claim 79, wherein the pathway guides the operating cord from opposing sides of the outer wand to one side of the outer wand.

81. The covering of claim 80, wherein the pathway includes a U-shaped pathway arranged and configured to guide the operating cord from opposing sides of the outer wand to one side of the outer wand.

82. The covering of claim 79, wherein the cord tether is keyed to the outer wand.

* * * * *